US011320757B2

(12) United States Patent
Kubo et al.

(10) Patent No.: US 11,320,757 B2
(45) Date of Patent: May 3, 2022

(54) IMAGE FORMING METHOD USING WHITE TONER AND COLOR TONER OF AT LEAST ONE COLOR

(71) Applicant: Konica Minolta, Inc., Tokyo (JP)

(72) Inventors: Yuya Kubo, Hino (JP); Kazuhiko Nakajima, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 320 days.

(21) Appl. No.: 16/747,869

(22) Filed: Jan. 21, 2020

(65) Prior Publication Data

US 2020/0285169 A1 Sep. 10, 2020

(30) Foreign Application Priority Data

Mar. 8, 2019 (JP) ..... JP2019-042750

(51) Int. Cl.
*G03G 15/20* (2006.01)
*G03G 15/01* (2006.01)
*G03G 9/093* (2006.01)

(52) U.S. Cl.
CPC ..... *G03G 15/0131* (2013.01); *G03G 9/09328* (2013.01); *G03G 9/09364* (2013.01)

(58) Field of Classification Search
CPC ..... G03G 15/0131; G03G 15/2039; G03G 9/09328; G03G 9/09364
USPC ..... 399/69, 298, 321
See application file for complete search history.

(56) References Cited

U.S. PATENT DOCUMENTS

2014/0341615 A1* 11/2014 Yamashita et al. .. G03G 9/0821 399/321
2014/0369723 A1* 12/2014 Takahashi et al. ..... G03G 15/2014 399/321

FOREIGN PATENT DOCUMENTS

JP 2012177763 A 9/2012
JP 2018084607 A 5/2018

* cited by examiner

*Primary Examiner* — William J Royer
(74) *Attorney, Agent, or Firm* — Lucas & Mercanti, LLP

(57) ABSTRACT

An image forming method includes forming an image by transferring and fixing white toner and color toner of at least one color to a recording medium, wherein when an endothermic peak top temperature and a toner softening point in a first temperature increasing process in differential scanning calorimetry of the white toner are Tmw (° C.) and Tspw (° C.), respectively, and an endothermic peak top temperature and a toner softening point in a first temperature increasing process in differential scanning calorimetry of the color toner are Tmc (° C.) and Tspc (° C.), respectively, Equations (1) and (2) below are satisfied:

[Math. 1]

$$3 \leq (Tmc - Tmw) \leq 20 \quad (1)$$

$$Tspw > Tspc \quad (2)$$

10 Claims, No Drawings

IMAGE FORMING METHOD USING WHITE TONER AND COLOR TONER OF AT LEAST ONE COLOR

The entire disclosure of Japanese patent Application No. 2019-042750, filed on Mar. 8, 2019, is incorporated herein by reference in its entirety.

BACKGROUND

Technological Field

The present invention relates to an image forming method.

Description of the Related Art

In recent years, interest in high added value of documents by electrophotographic systems has increased. Among them, there is a demand for technological development for "media compatibility" that allows application to recording media other than paper and "spot color toner" that is not limited to the conventional color gamut.

In particular, when a colored medium other than a white medium such as paper or a transparent medium is used, the presence of "white toner" is indispensable. There is a method in which white toner is used alone for a white image. However, there is a method in which white toner is used for improving the visibility of a color toner image in which a color image is formed on a white image. At that time, the performance required for the white toner includes rapid melting in order to improve the adhesion of the upper color toner image and the recording medium, and suppression of deterioration in image quality of the upper color toner image.

Various proposals have been made so far for the purpose of improving the performance of white toner. For example, JP 2012-177763 A discloses a method for reducing a gloss difference between a white image portion and a color image portion by controlling a heat absorption amount ratio derived from crystalline resin between white toner and color toner. Further, J P 2018-084607 A discloses that, in differential scanning calorimetry, an endothermic peak Tm (° C.) due to the crystalline resin in a first temperature increasing process and an exothermic peak Tc (° C.) due to the crystalline resin in a first temperature decreasing process after the first temperature increasing process exist, and white toner that satisfies a relationship of Tm>Tc becomes a toner for electrostatic charge image development that is excellent in low-temperature fixability and hardly causes stacking.

As described above, in a case where white toner is used for the lowermost layer and a full color image is formed on a non-white medium or the like, or in a case where a white image is formed only with white toner, the white toner layer is required to have high concealability by scattering ideally all light incident on the white toner layer. Therefore, many studies have been made so far to increase the concealability of white toner (see, for example, JP 2012-177763 A and JP 2018-084607 A).

However, there has been a problem that the techniques described in JP 2012-177763A and JP 2018-084607 A alone are not sufficient to achieve high speed, high image quality, and wide color gamut that are required especially in the production market. The present inventors have made researches based on the idea that, in order to achieve high speed, high image quality, and wide color gamut as required in the production market, the characteristics of white toner need to be designed comprehensively in combination with the characteristics of color toner other than white and the fixing system. As a result, it has been found that by controlling a storage elastic modulus at a fixing nip temperature of white toner and color toner other than white, excessive penetration of the white toner into a medium can be suppressed and high glossiness can be realized on an image surface. However, in a case of such a combination, a binding force between the white toner layer and the non-white color toner layer is weak, and it has been found that there is a problem that what is called folding fixing property is poor, and when paper is folded in half, the image fixed to the paper peels off from the paper surface, and the color of the lower layer can be seen. This poor folding fixing property is a problem that needs to be solved particularly in order to obtain image quality equivalent to that of offset printing. Further, in a case where white toner is used, there has been a problem that the low-temperature fixability becomes insufficient when a recording medium is concealed by white toner. In view of the above, it has been found that, in order to solve the above problems, it is necessary to achieve both the suppression of offset to a fixing member at a high temperature and the low-temperature fixability.

SUMMARY

In view of the above, an object of the present invention is to provide a means for achieving both suppression of offset to a fixing member at a high temperature and low-temperature fixability in an image forming method using white toner and color toner of at least one color.

To achieve the abovementioned object, according to an aspect of the present invention, an image forming method reflecting one aspect of the present invention comprises forming an image by transferring and fixing white toner and color toner of at least one color to a recording medium, wherein when an endothermic peak top temperature and a toner softening point in a first temperature increasing process in differential scanning calorimetry of the white toner are Tmw (° C.) and Tspw (° C.), respectively, and an endothermic peak top temperature and a toner softening point in a first temperature increasing process in differential scanning calorimetry of the color toner are Tmc (° C.) and Tspc (° C.), respectively, Equations (1) and (2) below are satisfied:

[Math. 1]

$$3 \leq (Tmc - Tmw) \leq 20 \quad (1)$$

$$Tspw > Tspc \quad (2)$$

DETAILED DESCRIPTION OF EMBODIMENTS

Hereinafter, one or more embodiments of the present invention will be described. However, the scope of the invention is not limited to the disclosed embodiments.

According to a first aspect of the present invention, there is provided an image forming method including forming an image by transferring and fixing white toner and color toner of at least one color to a recording medium, in which when an endothermic peak top temperature and a toner softening point in a first temperature increasing process in differential scanning calorimetry of the white toner are Tmw (° C.) and Tspw (° C.), respectively, and an endothermic peak top temperature and a toner softening point in a first temperature increasing process in differential scanning calorimetry of the color toner are Tmc (° C.) and Tspc (° C.), respectively, Equations (1) and (2) below are satisfied:

[Math. 2]

$$3 \leq (Tmc - Tmw) \leq 20 \quad (1)$$

$$Tspw > Tspc \quad (2)$$

In the present description, white toner includes at least binder resin and a white colorant, and may further include other additives, such as a release agent, and an external additives as necessary. Further, in the present description, color toner includes binder resin and a colorant of a color other than white, and may further include other additives, such as a release agent, and an external additives as necessary. Note that a color means a color other than white (for example, yellow, magenta, cyan, black, or the like).

In the image forming method of the present invention, in a case where there are two or more kinds of color toners, generally, all the color toners form a toner image (hereinafter also simply referred to as "color toner image") composed of the color toners. For this reason, in the image forming method of the present invention, in a case where there are two or more color toners, all the color toners preferably satisfy above Equations (1) and (2) in relation to the white toner, and all the color toners preferably satisfy a more preferably range (a relationship of Equation (3) and the like) in above Equations (1) and (2) in relation to the white toner, and a more preferable condition relating to the white toner and the color toner (a relationship of Equation (4), Equation (5), Equation (6), Equation (7), and the like).

The details of the reason why the above-described effect can be obtained by the image forming method of the present invention are not clear, but the mechanism described below is conceivable. Note that the mechanism described below is based on speculation, and the present invention is not limited to the mechanism described below.

A component contained in the white toner of the present invention has a low melting point compared to a component contained in the color toner, and therefore has high melting property in a high temperature region at the time of fixing and fixing property between paper and toner can be improved. On the other hand, the color toner layer formed using the color toner of the present invention has high melting property and therefore has not only high adhesion between the toner and the toner but also a contained high melting point component holds elasticity in a high temperature region at the time of fixing on an interface with the fixing member, and exerts a separation effect on the fixing member (roller). As a result, both the suppression of offset to the fixing member at a high temperature and the low-temperature fixability can be achieved.

Note that the above mechanism is based on speculation, and the present invention does not adhere to the above mechanism.

Hereinafter, a configuration of the present invention will be described in detail.

(Relationship Between Each Endothermic Peak Top Temperature and Each Toner Softening Point of White Toner and Color Toner)

In the present invention, when an endothermic peak top temperature and a toner softening point in a first temperature increasing process in the differential scanning calorimetry of the white toner are Tmw (° C.) and Tspw (° C.), respectively, and an endothermic peak top temperature and a toner softening point in a first temperature increasing process in the differential scanning calorimetry of the color toner of the present invention are Tmc (° C.) and Tspc (° C.), respectively, Equations (1) and (2) below are satisfied. By having such a configuration, the above effects can be effectively expressed.

[Math. 3]

$$3 \leq (Tmc - Tmw) \leq 20 \quad (1)$$

$$Tspw > Tspc \quad (2)$$

When the above Equations (1) and (2) are not satisfied, that is, when Tspw≤Tspc or (Tmc−Tmw)>20 is satisfied, the low-temperature fixability deteriorates. Further, in a case where 3>(Tmc−Tmw) is satisfied, the elastic retention effect at a high temperature is not exerted, and the hot offset resistance deteriorates.

From the above viewpoint, the softening point Tspc (° C.) of the color toner and the softening point Tspw (° C.) of the white toner preferably satisfy Equation (3) below:

[Math. 4]

$$5 \leq (Tspw - Tspc) \leq 45 \quad (3)$$

In above Equation (3), when 5≤(Tspw−Tspc) is satisfied, the elastic retention effect at a high temperature is sufficiently exerted, and the hot offset resistance is further improved. That is, it is preferable in that the effect of suppressing the offset to the fixing member at a high temperature becomes more remarkable. Further, (Tspw−Tspc)≤45 is preferable in that the low-temperature fixability becomes more remarkable.

Further, from the above viewpoint, the endothermic peak top temperature Tmc and the softening point Tspc in the first temperature increasing process in the differential scanning calorimetry of the color toner preferably satisfy the Equations (4) and (5) below:

[Math. 5]

$$65 \leq Tmc \leq 85 \quad (4)$$

$$90 \leq Tspc \leq 115 \quad (5)$$

In Equations (4) and (5), when 90≤Tspc and 65≤Tmc are satisfied, the elastic retention effect at a high temperature is sufficiently exerted, and the hot offset resistance is further improved. That is, it is preferable in that the effect of suppressing the offset to the fixing member at a high temperature becomes more remarkable. Further, when Tspc≤115 and Tmc≤85 are preferable in that the low-temperature fixability becomes more remarkable. From the above viewpoint, Tmc is more preferably 70° C. or higher and 80° C. or lower.

Furthermore, from the above viewpoint, the endothermic peak top temperature Tmw and the softening point Tspw in the first temperature increasing process in the differential scanning calorimetry of the white toner preferably satisfy the Equations (6) and (7) below:

[Math. 6]

$$60 \leq Tmw \leq 80 \quad (6)$$

$$105 \leq Tspw \leq 150 \quad (7)$$

In Equations (6) and (7), when 105≤Tspw and 60≤Tmw are satisfied, the elastic retention effect at a high temperature is sufficiently exerted, and the hot offset resistance is further improved. That is, it is preferable in that the effect of suppressing the offset to the fixing member at a high temperature becomes more remarkable. Further, Tspw≤150 and Tmw≤80 are preferable in that the low-temperature fixability becomes more remarkable.

The white toner and the color toner satisfying Equations (1) and (2), and further Equations (3) to (7) can be realized by adjusting a component and a structure (for example, a kind of amorphous resin, crystalline resin, and the like, a blending amount, a core-shell structure, and the like) constituting the toner described below. The present invention is characterized in that the color toner and the white toner having different melting points and softening points are combined so as to satisfy above Equations (1) and (2), and further Equations (3) to (7). As to the technique for producing toner of each color having a desired melting point and softening point itself, an existing technique can be utilized.

(Measurement Method of Peak Top Temperature of Endothermic Peak)

As to the peak top temperature of the endothermic peak in the first temperature increasing process in the differential scanning calorimetry (DSC) measurement of the white toner and the color toner, DSC measurement can be performed by differential scanning calorimetry analysis using a differential scanning calorimeter, for example, a differential scanning calorimeter "DSC-7" (manufactured by PerkinElmer Co., Ltd.) and a thermal analyzer controller "TAC7/DX" (manufactured by PerkinElmer Co., Ltd.).

Specifically, 0.5 mg of a measurement sample is sealed in an aluminum pan (KITNO.0219-0041), which is set in a sample holder of "DSC-7", temperature control of Heat (temperature increase)−cool (temperature decrease)−Heat (temperature increase) is performed under measurement conditions of a measurement temperature of 0 to 200° C., a temperature increase rate of 10° C./min, and a temperature decrease rate of 10° C./min, and analysis is performed based on data at 1st.Heat (the first temperature increasing process). However, an empty aluminum pan is used for measurement of a reference. In a case where there are a plurality of peaks, one having a highest peak height is defined as an endothermic peak of the toner.

(Measurement Method of Softening Point)

Toner softening points of the white toner and the color toner can be measured by a measurement method described below.

First, under an environment of 20° C. and 50% RH, 1.1 g of a measurement sample is placed and leveled in a petri dish and left for 12 hours or more, and then is pressurized with a force of 3820 kg/cm$^2$ for 30 seconds with a molding machine "SSP-10A" (manufactured by Shimadzu Corporation) to manufacture a cylindrical molded sample with a diameter of 1 cm. Next, this molded sample is extruded from a hole (1 mm diameter by 1 mm) of a cylindrical die under conditions of a load of 196 N (20 kgf), a starting temperature of 60° C., a preheating time of 300 seconds, and a temperature increase rate of 6° C./min by a flow tester "CFT-500D" (manufactured by Shimadzu Corporation) under an environment of 24° C. and 50% RH by using a 1-cm diameter piston, and an offset method temperature $T_{offset}$ measured with setting of an offset value of 5 mm by a melting temperature measurement method of a temperature increase method is taken as a softening point of the measurement sample.

<Configuration of Toner (White Toner and Color Toner) and Toner Base Particles>

The toner (white toner and color toner) refers to an aggregate of toner particles. The white toner refers to an aggregate of white toner particles, and the color toner refers to an aggregate of toner particles for each color other than white. For example, cyan toner refers to an aggregate of cyan toner particles. A toner particle of each color has a configuration in which an external additive is attached to a surface of a toner base particle of each color. The toner base particle of each color constitutes a base of a toner particle of each color, and includes binder resin and a colorant of each color.

(Colorant)

As the colorant, carbon black, a magnetic material, a dye, a pigment, and the like can be optionally used. As the carbon black, channel black, furnace black, acetylene black, thermal black, lamp black, and the like are used. As the magnetic material, ferromagnetic metal such as iron, nickel, and cobalt, an alloy containing these types of metal, a compound of ferromagnetic metal such as ferrite and magnetite, an alloy that does not contain ferromagnetic metal but exhibits ferromagnetism by heat treatment, an alloy of a type referred to as a Heusler alloy such as manganese-copper-aluminum and manganese-copper-tin, chromium dioxide, and the like can be used.

Specific examples of the white colorant include inorganic pigments (for example, heavy calcium carbonate, light calcium carbonate, titanium oxide, aluminum hydroxide, titanium white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, smectite, and the like), organic pigments (for example, polystyrene resin particles, urea formalin resin particles). Further, pigment which has a hollow structure, for example, a hollow resin particle, hollow silica, and the like, can be used. From the viewpoint of chargeability and concealability, the white colorant is preferably titanium oxide. Titanium oxide can use a crystal structure of any of an anatase type, a rutile type, a brookite type, and the like.

An average particle diameter of the white colorant is preferably 10 to 1000 nm, and more preferably 50 to 500 mm. Further, surface treatment may be applied for providing dispersibility.

Examples of the black colorant include carbon black such as furnace black, channel black, acetylene black, thermal black, and lamp black, and furthermore magnetic powder such as magnetite and ferrite.

Colorants for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48;1, C.I. Pigment Red 53;1, C.I. Pigment Red 57;1, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, Pigment Red 184, C.I. Pigment Red 222, and the like.

Further, colorants for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, and the like.

Furthermore, colorants for green or cyan include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Green 7, and the like.

These colorants can be used alone or two or more of these colorants can be selected and used as required.

The average particle diameter of the colorant of a color other than white is preferably 10 to 1000 nm, and more preferably 50 to 500 nm.

An added amount of the colorant is preferably in the range of 1 to 60% by mass, more preferably 2 to 25% by mass, with respect to mass of the entire toner. Within such a range, the color reproducibility of an image can be ensured.

Note that, for example, in an image forming method using yellow, magenta, cyan, and black in addition to white, any toner other than that of white may be a toner that forms a color toner image. Therefore, in such a method, at least one toner of yellow, magenta, cyan, and black satisfies above Equations (1) and (2) in relation to the white toner, and furthermore preferably satisfies at least one of Equations (3) to (7).

<Binder Resin (Amorphous Resin and Crystalline Resin)>

As the binder resin, conventionally publicly-known resin used for toner can be used. Specifically, for example, a polyester resin; a polymer of styrene such as polyvinyl toluene and a substitute of styrene; styrenic copolymers such as a styrene-p-chlorostyrene copolymer, a styrene-propylene copolymer, a styrene-vinyltoluene copolymer, a styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-a-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, and the like.

That is, the toner (white toner and color toner) of the present invention contains binder resin. As the binder resin, a conventionally publicly-known resin used for toner can be used as described above, and crystalline resin and amorphous resin are preferably contained. In the present description, "the binder resin contains crystalline resin" may indicate a mode in which the binder resin contains the crystalline resin itself, or a mode in which the binder resin contains a segment contained in other resin, such as a crystalline polyester polymer segment in hybrid crystalline polyester resin and a crystalline polyester polymer segment in hybrid amorphous polyester resin. Further, in the present description, "the binder resin contains amorphous resin" may indicate a mode in which the binder resin contains the amorphous resin itself, or a mode in which the binder resin contains a segment contained in other resin, such as an amorphous polymer segment in hybrid crystalline polyester resin and an amorphous polyester polymer segment in hybrid amorphous polyester resin.

(Crystalline Resin)

In the present invention, the crystalline resin refers to resin having a clear endothermic peak instead of a stepwise endothermic change in a differential calorimetric curve measured with a differential scanning calorimeter (DSC). The clear endothermic peak specifically means a peak in which a half-value width of the endothermic peak is within 15° C. when measured at a temperature increase rate of 10° C./min in DSC measurement. Note that the DSC measurement uses a differential scanning calorimeter (Diamond DSC manufactured by PerkinElmer Co., Ltd.), uses a melting point of indium and zinc for temperature correction of a detection unit of the device, and uses heat of fusion of indium for correction of a calorific value.

The total amount of the toner other than the external additive, that is, the content of the crystalline resin with respect to the toner base particles is preferably 1% to 40% by mass, or more preferably 5% to 30% by mass with respect to the entire toner from the viewpoint of obtaining sufficient low-temperature fixability and heat-resistant storage property. In this manner, while an effect of improving the sharp melt property of the binder resin and improving the low-temperature fixability of the toner is obtained, lowering in heat resistance can be suppressed. Further, in a case where the binder resin contains amorphous vinyl resin, the crystalline resin can be uniformly dispersed in the toner base particles, and crystallization can be sufficiently suppressed. If the content of the crystalline resin is 1% by mass or more, a sufficient plastic effect is obtained, which is preferable since the low-temperature fixability becomes sufficient. If the content is 40% by mass or less, the thermal stability as toner, the stability against physical stress, and the heat-resistant storage property become sufficient, which is preferable. For example, the peak top temperature and softening point of the endothermic peaks of the white toner and the color toner can be easily controlled by selecting a configuration of the amorphous resin and an appropriate production method, and above Equations (1) and (2), and, furthermore, Equations (3) to (7) can be satisfied.

In the present invention, the color toner preferably contains crystalline resin as the binder resin, and the content of the crystalline resin with respect to the total binder resin is preferably in the range of 2% by mass or more and 20% by mass or less. In this manner, while an effect of improving the sharp melt property of the binder resin and improving the low-temperature fixability of the toner is obtained, lowering in heat resistance can be suppressed. Further, in a case where the binder resin contains amorphous vinyl resin, the crystalline resin can be uniformly dispersed in the toner base particles, and crystallization can be sufficiently suppressed. If the content of the crystalline resin is 2% by mass or more, a sufficient plastic effect is obtained, which is preferable in that the low-temperature fixability becomes more remarkable. If the content is 20% by mass or less, heat resistance is improved, which is preferable. As a result, thermal stability as toner, stability against physical stress, and heat-resistant storage property become sufficient. From the above viewpoint, the content of the crystalline resin with respect to the total binder resin is more preferably 5% by mass or more and 20% by mass or less, and further preferably 7% by mass or more and 15% by mass or less. In the above preferable range or more preferably range, for example, the peak top temperature and softening point of the endothermic peaks of the white toner and the color toner can be easily controlled by selecting a configuration of the amorphous resin and an appropriate production method, and above Equations (1) and (2), and, furthermore, Equations (3) to (7) can be satisfied.

Further, the white toner is not particularly limited, and a conventionally publicly-known toner can be used. However, as in the case of the color toner, the white toner contains the crystalline resin as the binder resin, and the content of the crystalline resin with respect to the total binder resin may be within the range of 2.0% to 20% by mass.

The number average molecular weight (Mn) of the crystalline resin is preferably 3000 or more and 12500 or less, and more preferably 4000 or more and 11000 or less, from the viewpoint of low-temperature fixability and gloss stability. The weight average molecular weight (Mw) of the crystalline resin is preferably 10000 or more and 100000 or less, more preferably 15000 or more and 80000 or less, and particularly preferably 20000 or more and 50000 or less. If Mw and Mn described above are too small, the strength of a fixed image may be insufficient, the crystalline resin may be pulverized during stirring of emulsion, or a glass transition temperature Tg of the toner may be lowered due to an excessive plastic effect and thermal stability of the toner may be lowered. Further, if Mw and Mn described above are too large, the sharp melt property is hardly expressed and the fixing temperature may become too high. Mw and Mn described above can be obtained from the molecular weight distribution measured by gel permeation chromatography (GPC) as described below.

(Measurement Method of Molecular Weight of Crystalline Resin)

A sample is added to tetrahydrofuran (THF) to a concentration of 0.1 mg/mL, heated to 40° C. so that the sample is completely dissolved, and then treated with a membrane filter with pore size of 0.2 μm, so that a sample solution (sample) is prepared. After the above, measurement was performed under conditions described below. Specifically, using a GPC device HLC-8220GPC (manufactured by Tosoh Corporation) and a column "TSKgelSuperH3000" (manufactured by Tosoh Corporation), while a column temperature is kept at 40° C., THF as a carrier solvent (eluent) is allowed to flow at a flow rate of 0.6 mL/min. Together with the carrier solvent, 100 μL of the prepared sample solution is injected into the GPC device, and the sample is detected using a differential refractive index detector (RI detector). Then, the molecular weight distribution of the sample is calculated using a calibration curve measured using 10 points of monodisperse polystyrene standard particles. Further, in the data analysis, in a case where the peak due to the filter is confirmed, the data analyzed by setting the baseline before the peak is taken as the molecular weight of the sample.

Measurement model: GPC device HLC-8220GPC manufactured by Tosoh Corporation

Column: "TSKgelSuperH3000" manufactured by Tosoh Corporation

Eluent: THF

Temperature: Column thermostat 40.0° C.

Flow rate: 0.6 ml/min

Concentration: 0.1 mg/mL (0.1 wt/vol %)

Calibration curve: Standard polystyrene sample manufactured by Tosoh Corporation Injection amount: 100

Solubility: Complete dissolution (heated to 40° C.)

Pretreatment: Filtration with 0.2-μm filter

Detector: differential refractometer (RI).

One or more kinds of crystalline resin may be used. The crystalline resin is not particularly limited. However, for example, resin having a structure in which another component is copolymerized to the principal chain of the crystalline resin and showing a clear endothermic peak as mentioned above is equivalent to the crystalline resin referred to in the present invention. Examples of the crystalline resin according to the present invention include crystalline polyolefin resin, crystalline polydiene resin, crystalline polyester resin, crystalline polyamide resin, crystalline polyurethane resin, crystalline polyacetal resin, crystalline polyethylene terephthalate resin, crystalline polybutylene terephthalate resin, crystalline polyphenylene sulfide resin, crystalline polyetheretherketone resin, crystalline polytetrafluoroethylene resin, and the like. Among these, crystalline polyester resin is preferable from the viewpoint of ease of use, sufficient low-temperature fixability, and gloss uniformity. The crystalline polyester resin, which melts at the time of heat fixing and acts as a plasticizer for the amorphous resin and can improve the low-temperature fixability, is preferable.

From the viewpoint of improving the low-temperature fixability for fixing a toner image at a lower temperature, in the white toner and the color toner, the binder resin preferably contains the crystalline resin, and the crystalline resin is preferably polyester resin. Here, among the white toner and the color toner, preferably at least the color toner contains the crystalline resin as the binder resin, and the crystalline resin is polyester resin, and, more preferably, both the white toner and the color toner contain the crystalline resin as the binder resin, and the crystalline resin is crystalline polyester resin. Further, from the viewpoint of the low-temperature fixability and heat resistant preservability of the toner, as the binder resin, crystalline polyester resin and amorphous resin are preferably used in combination, and crystalline polyester resin and vinyl resin are more preferably used in combination.

<Crystalline Polyester Resin>

The crystalline polyester resin is resin having a clear endothermic peak instead of a stepwise endothermic change in differential scanning calorimetry (DSC) among publicly-known polyester resins obtained by a polycondensation reaction between divalent or higher valence carboxylic acid (polyvalent carboxylic acid) and divalent or higher valence alcohol (polyhydric alcohol). Specifically, the clear endothermic peak means a peak, in which a half-value width of the endothermic peak is within 15° C. when measurement is performed at a temperature increase rate of 10° C./min in the differential scanning calorimetry (DSC) described in the embodiment. Such crystalline polyester resin is excellent in ease of use, and sufficient low-temperature fixability and gloss uniformity can be obtained. Further, the crystalline polyester resin melts at the time of heat fixing and acts as a plasticizer for the amorphous resin and can improve the low-temperature fixability. Further, one or more kinds of the crystalline polyester resin may be used.

The crystalline polyester resin is not particularly limited as long as the crystalline polyester resin is as defined above. For example, resin having a structure in which another component is copolymerized to the principal chain of the crystalline polyester resin and showing a clear endothermic peak as mentioned above is equivalent to the crystalline polyester resin referred to in the present invention.

The number average molecular weight (Mn) of the crystalline polyester resin is preferably 3000 or more and 12500 or less, and more preferably 4000 or more and 11000 or less, from the viewpoint of low-temperature fixability and gloss stability. The weight average molecular weight (Mw) of the crystalline polyester resin is preferably 10000 or more and 100000 or less, more preferably 12000 or more and 80000 or less, and particularly preferably 14000 or more and 50000 or less. Within such a range, the resulting toner particles do not have a low melting point as a whole and are excellent in blocking resistance and excellent in low-temperature fixability. The number average molecular weight (Mn) and the weight average molecular weight (Mw) can be measured by gel permeation chromatography (GPC).

The acid value (AV) of the crystalline polyester resin is preferably 5 to 70 mgKOH/g. The acid value can be measured according to the method described in JIS K2501: 2003.

In the present invention, in a case where the binder resin contains crystalline polyester resin, the content of the crystalline polyester resin with respect to the binder resin is preferably 2% by mass or more and 20% by mass or less, more preferably 5% by mass or more and 20% by mass or less, and further preferably 7% by mass or more and 15% by mass or less. When the content of the crystalline polyester resin is 2% by mass or more, the low-temperature fixability is excellent. When the content of the crystalline polyester resin is 20% by mass or less, the heat resistance is excellent.

The crystalline polyester resin is produced from a polyvalent carboxylic acid component and a polyhydric alcohol component. The valences of the polyvalent carboxylic acid component and the polyhydric alcohol component are preferably 2 to 3, particularly preferably 2.

(Polyvalent Carboxylic Acid)

The polyvalent carboxylic acid is a compound containing two or more carboxy groups in one molecule. Examples of the polyvalent carboxylic acid include dicarboxylic acid. The dicarboxylic acid may be of one kind or more, preferably an aliphatic dicarboxylic acid, and may further contain an aromatic dicarboxylic acid. The aliphatic dicarboxylic acid is preferably of a linear type from the viewpoint of enhancing the crystallinity of the crystalline polyester resin.

Examples of the aliphatic dicarboxylic acid include oxalic acid, malonic acid, succinic acid, glutaric acid, adipic acid (hexanedioic acid), pimelic acid, suberic acid (octanedioic acid), azelaic acid, sebacic acid (decanedioic acid)), n-dodecyl succinic acid, saturated aliphatic dicarboxylic acid, such as 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, 1,18-octadecanedicarboxylic acid, lower alkyl ester of these, and acid anhydrides of these. Among these, aliphatic dicarboxylic acid having 6 or more and 16 or less carbons are preferable, and aliphatic dicarboxylic acid having 10 or more and 14 or less carbons are more preferable, from the viewpoint that effects of both low-temperature fixability and transferability can be obtained.

Examples of the aromatic dicarboxylic acid include phthalic acid, terephthalic acid, isophthalic acid, orthophthalic acid, t-butylisophthalic acid, 2,6-naphthalenedicarboxylic acid, and 4,4'-biphenyldicarboxylic acid. Among these, terephthalic acid, isophthalic acid, or t-butylisophthalic acid is preferable from the viewpoints of availability and ease of emulsification.

As the polyvalent carboxylic acid, in addition to the above, cycloaliphatic dicarboxylic acid such as cycloaliphatic dicarboxylic acid, polyvalent carboxylic acid of trivalent or higher valence such as trimellitic acid and pyromellitic acid; and anhydrides of these carboxylic acid compounds, or alkyl ester having one to three carbons can be used.

One kind of the polyvalent carboxylic acid described above may be used alone or two or more kinds of the polyvalent carboxylic acid may be used in combination.

The content in the constituting unit derived from the aliphatic dicarboxylic acid with respect to the constituting unit derived from the dicarboxylic acid in the crystalline polyester resin is preferably 50 mol % or more, more preferably 70 mol % or more, further preferably 80 mol % or more, and particularly preferably 100 mol % from the viewpoint of sufficiently ensuring the crystallinity of the crystalline polyester resin.

(Polyhydric Alcohol)

The polyhydric alcohol is a compound containing two or more hydroxyl groups in one molecule. Examples of the polyhydric alcohol component include diol. The diol may be of one kind or more, and is preferably aliphatic diol, and may further contain other diols. The aliphatic diol is preferably of a linear type from the viewpoint of enhancing the crystallinity of the crystalline polyester resin.

Examples of the aliphatic diol include ethylene glycol, propylene glycol (1,2-propanediol), 1,3-propanediol, neopentyl glycol (2,2-dimethyl-1,3-propanediol), 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, the aliphatic diol having 2 or more and 20 or less carbons are preferable, and aliphatic diol having 4 or more and 12 or less carbons are more preferable, from the viewpoint that effects of both low-temperature fixability and transferability can be obtained.

Examples of other diols include diols having a double bond and diols having a sulfonic acid group. Specifically, examples of diols having a double bond include 1,4-butenediol, 2-butene-1,4-diol, 3-butene-1,6-diol, and 4-butene-1,8-diol.

Examples of polyhydric alcohol of trivalent or higher valence include glycerin, pentaerythritol, trimethylolpropane, sorbitol, and the like.

One kind of the polyhydric alcohol may be used alone or two or more kinds of the polyhydric alcohol may be used in combination.

The content of the constituting unit derived from the aliphatic diol with respect to the constituting unit derived from the diol in the crystalline polyester resin is preferably 50 mol % or more, more preferably 70 mol % or more, further preferably 80 mol % or more, and particularly preferably 100 mol % from the viewpoint of improving the low-temperature fixability of the toner and the glossiness of the finally formed image.

The ratio of the diol and the dicarboxylic acid in the monomer of the crystalline polyester resin in the equivalent ratio [OH]/[COOH] of the hydroxy group [OH] of the diol and the carboxy group [COOH] of the dicarboxylic acid is preferably 2.0/1.0 or more and 1.0/2.0 or less, more preferably 1.5/1.0 or more and 1.0/1.5 or less, and particularly preferably 1.3/1.0 or more and 1.0/1.3 or less.

The monomer constituting the crystalline polyester resin preferably contains 50% by mass or more and more preferably contains 80% by mass or more of a linear aliphatic monomer. In a case where an aromatic monomer is used, the crystalline polyester resin often has a high melting point (temperature at the peak top of the endothermic peak), and in a case where a branched aliphatic monomer is used, the crystallinity is often low. Therefore, it is preferable to use a linear aliphatic monomer as the monomer.

The crystalline polyester resin can be synthesized by polycondensation (esterification) of the polyvalent carboxylic acid and the polyhydric alcohol using a publicly-known esterification catalyst.

The catalyst that can be used for the synthesis of the crystalline polyester resin may be one kind or more, and examples of the catalyst include alkali metal compounds such as sodium and lithium; compounds containing Group 2 elements such as magnesium and calcium; metal compounds such as aluminum, zinc, manganese, antimony, titanium, tin, zirconium, and germanium; phosphorous acid compounds; phosphoric acid compounds; and amine compounds.

Specifically, examples of the tin compound include dibutyltin oxide, tin octylate, tin dioctylate, and salts of these. Examples of titanium compounds include titanium alkoxides such as tetranormal butyl titanate, tetraisopropyl titanate, tetramethyl titanate, tetrastearyl titanate; titanium acylates such as polyhydroxy titanium stearate; and titanium chelates such as titanium tetraacetylacetonate, titanium lactate, titanium triethanolamate. Examples of germanium compounds include germanium dioxide, and examples of aluminum compounds include oxides such as polyaluminum hydroxide, aluminum alkoxide, and tributylaluminate.

The polymerization temperature of the crystalline polyester resin is preferably 150° C. or more and 250° C. or less. Further, the polymerization time is preferably 0.5 hours or more and 10 hours or less. During the polymerization, the pressure in the reaction system may be reduced as necessary.

Note that the structure of the crystalline resin and the constituent monomer affect the crystallinity and fusion heat of the crystalline resin. From the viewpoint of adjusting the crystallinity of the crystalline resin to a range preferable for fixing, the crystalline resin is preferably hybrid crystalline polyester resin described below. The hybrid crystalline polyester resin may be of one kind or more. Further, the hybrid crystalline polyester resin may be replaced with the whole amount or part of the crystalline polyester resin.

(Hybrid Crystalline Polyester Resin)

In the present invention, the crystalline resin is preferably crystalline polyester resin. Furthermore, one kind of the crystalline resin is preferably hybrid crystalline polyester resin containing a structure of crystalline polyester resin and a structure of amorphous resin. The hybrid crystalline polyester resin has a hybrid structure, so that compatibility with amorphous resin is improved, a finer dispersion state can be maintained in the binder resin, sharp meltability of the crystalline resin is exerted more during fixing, and low-temperature fixability is improved. Further, a case where the toner base particles have a core-shell structure is preferable, since the crystalline polyester resin is hardly exposed on the toner particle surface as the hybrid crystalline polyester resin is contained in the core portion.

The hybrid crystalline polyester resin is resin having a structure in which a crystalline polyester polymer segment and an amorphous polymer segment other than the polyester polymer segment are chemically bonded. The crystalline polyester polymer segment means a portion derived from crystalline polyester resin. That is, it means a molecular chain having the same chemical structure as a molecular chain constituting the crystalline polyester resin described above. Further, the amorphous polymer segment means a portion derived from amorphous resin. That is, it means a molecular chain having the same chemical structure as a molecular chain constituting amorphous resin described later.

(Molecular Weight of Hybrid Crystalline Polyester Resin Having High Molecular Weight)

The weight average molecular weight (Mw) of the hybrid crystalline polyester resin is preferably 20000 or more and 50000 or less. By setting Mw of the hybrid crystalline polyester resin to 50000 or less, sufficient low-temperature fixability can be obtained. On the other hand, by setting Mw of the hybrid crystalline polyester resin to 20000 or more, the excessive progress of the compatibility between the hybrid resin and the amorphous resin during storage of the toner is suppressed, and a defective image due to the fusion between the toner can be effectively suppressed. To the measurement of the molecular weight, the method for measuring the molecular weight of the crystalline resin described above can be applied.

The number average molecular weight (Mn) of the hybrid crystalline polyester resin is preferably 3000 or more and 12500 or less, and more preferably 4000 or more and 11000 or less, from the viewpoint of ensuring both sufficient low-temperature fixability and excellent long-term storage stability. By setting Mn of the hybrid crystalline polyester resin to 12500 or less, sufficient low-temperature fixability can be obtained. On the other hand, by setting Mn of the hybrid crystalline polyester resin to 3000 or more, the excessive progress of the compatibility between the hybrid resin and the amorphous resin during storage of the toner is suppressed, and a defective image due to the fusion between the toner can be effectively suppressed. To the measurement of the molecular weight, the method for measuring the molecular weight of the crystalline resin described above can be applied.

In the present invention, in a case where the binder resin contains hybrid crystalline polyester resin, the content of the hybrid crystalline polyester resin with respect to the binder resin is preferably 2% by mass or more and 20% by mass or less, more preferably 5% by mass or more and 20% by mass or less, and further preferably 7% by mass or more and 15% by mass or less. When the content of the hybrid crystalline polyester resin is 2% by mass or more, the low-temperature fixability is excellent. When the content of the hybrid crystalline polyester resin is 20% by mass or less, the heat resistance is excellent.

The chemically bonding structure is not particularly limited either, and may be a block copolymer or a graft copolymer. The crystalline polyester polymer segment is preferably grafted with the amorphous polymer segment as the main chain. That is, the hybrid crystalline polyester resin is preferably a graft copolymer having the amorphous polymer segment as a main chain and the crystalline polyester polymer segment as a side chain.

Hereinafter, the hybrid crystalline polyester resin having such a structure will be described.

<Crystalline Polyester Polymer Segment>

The crystalline polyester polymer segment indicates a portion derived from the crystalline polyester resin. That is, it indicates a molecular chain having the same chemical structure as that constituting the crystalline polyester resin.

The crystalline polyester polymer segment is similar to the above-described crystalline polyester resin, and is a portion derived from a publicly-known polyester resin obtained by a polycondensation reaction between the polyvalent carboxylic acid and the polyhydric alcohol described above. The crystalline polyester polymer segment may be synthesized from polyvalent carboxylic acid and polyhydric alcohol in a similar manner as the crystalline polyester resin described above. Note that the polyvalent carboxylic acid component and the polyhydric alcohol component constituting the crystalline polyester polymer segment are similar to the contents of the sections of "Polyvalent carboxylic acid" and "Polyhydric alcohol" described above for the crystalline polyester resin, and will be omitted from the description.

The content of the crystalline polyester polymer segment is preferably 80% by mass or more and 98% by mass or less, and more preferably 90% by mass or more and 95% by mass or less with respect to the total amount of the hybrid crystalline polyester resin. By setting the content to be within the above range, sufficient crystallinity can be imparted to the hybrid crystalline polyester resin. Note that a constituent component of each segment in the hybrid crystalline polyester resin (or toner) and the content of the constituent component can be identified by using, for example, a publicly-known method, such as nuclear magnetic resonance (NMR) measurement, methylation reaction pyrolysis gas chromatography/mass spectrometry (Py-GC/MS), and the like.

It is preferable that the crystalline polyester polymer segment further includes a monomer having an unsaturated bond in the monomer from the viewpoint of introducing a chemical bond site with the amorphous polymer segment into the segment. The monomer having an unsaturated bond is, for example, a polyhydric alcohol having a double bond, and examples of the monomer include polyhydric carboxylic acid having a double bond, such as methylene succinic acid, fumaric acid, maleic acid, 3-hexenedioic acid, and 3-octenedioic acid; 2-butene-1,4-diol, 3-butene-1,6-diol, and 4-butene-1,8-diol. The content of the constituting unit derived from the monomer having an unsaturated bond in the crystalline polyester polymer segment is preferably 0.5% by mass or more and 20% by mass or less.

Note that a functional group such as a sulfonic acid group, a carboxy group, or a urethane group may be further introduced into the hybrid crystalline polyester resin. The introduction of the functional group may be performed in the crystalline polyester polymer segment or in the amorphous polymer segment.

The hybrid crystalline polyester resin includes an amorphous polymer segment in addition to the crystalline polyester polymer segment. By using a graft copolymer, the orientation of the crystalline polyester polymer segment can be easily controlled, and sufficient crystallinity can be imparted to the hybrid crystalline polyester resin.

<Amorphous Polymer Segment>

The amorphous polymer segment means a portion derived from amorphous resin. That is, it indicates a molecular chain having the same chemical structure as that constituting the amorphous resin. The amorphous polymer segment improves the affinity between the amorphous resin that may be included in the binder resin in the present invention and the hybrid crystalline polyester resin. In this manner, the hybrid resin is easily taken into the amorphous resin, and the charging uniformity of the toner is further improved. A constituent component of the amorphous polymer segment in the hybrid crystalline polyester resin (or toner) and the content of the constituent component can be identified by using, for example, a publicly-known method, such as nuclear magnetic resonance (NMR) measurement, methylation reaction pyrolysis gas chromatography/mass spectrometry (Py-GC/MS), and the like.

Further, the amorphous polymer segment is a polymer segment that does not have a melting point and has a relatively high glass transition temperature (Tg) when differential scanning calorimetry (DSC) is performed on resin having the same chemical structure and molecular weight as the segment. The amorphous polymer segment, like the amorphous resin, preferably has a glass transition temperature (Tg) in the first temperature increasing process of DSC of 30° C. or more and 80° C. or less, and more preferably 40° C. or more and 65° C. or less. Note that the glass transition temperature (Tg) can be measured by a similar method as that for Tg of the amorphous resin.

The amorphous polymer segment is preferably composed of the same kind of resin as the amorphous resin (for example, vinyl resin) contained in the binder resin, from the view point of improving the affinity with the binder resin and charge uniformity of the toner. By the above mode, the affinity of the hybrid crystalline polyester resin and the amorphous resin is further improved. The "same kind of resin" means resin having a characteristic chemical bond in a repeating unit.

The "characteristic chemical bond" complies with "Classification of polymer" described in Substance and Material Database of National Institute for Materials Science (NIMS) (http://polymer.nims.go.jp/PoLyInfo/guide/jp/term_polymer.html). That is, chemical bonds constituting polymers classified according to a total of 22 types of polymers, which are polyacryl, polyamide, polyanhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers, are referred to as the "characteristic chemical bond".

Further, the "same kind of resin" in a case where the resin is a copolymer means resin having a common characteristic chemical bond in a case where the monomer type having the above chemical bond is used as a constituent unit in the chemical structure of a plurality of monomer kinds constituting the copolymer. Therefore, even in a case where the characteristics indicated by the resin itself are different from each other, or even in a case where the molar component ratios of the monomer kinds constituting the copolymer are different from each other, the same kind of resin is deemed to be used as long as the resin has a common characteristic chemical bond.

For example, resin (or polymer segment) formed of styrene, butyl acrylate, and acrylic acid and resin (or polymer segment) formed of styrene, butyl acrylate, and methacrylic acid have at least a chemical bond constituting polyacrylic, and are the same kind of resin. To further illustrate, resin (or polymer segment) formed of styrene, butyl acrylate, and acrylic acid and resin (or polymer segment) formed by styrene, butyl acrylate, acrylic acid, terephthalic acid, and fumaric acid have at least a chemical bond constituting polyacrylic as a chemical bond common to each other. Therefore, these are the same kind of resin.

Furthermore, the amorphous polymer segment preferably further contains the amphoteric compound described above in the monomer from the viewpoint of introducing a chemical bonding site with the crystalline polyester polymer segment into the amorphous polymer segment. The content of the constituting unit derived from the amphoteric compound in the amorphous polymer segment is preferably 0.5% by mass or more and 20% by mass or less.

The content of the amorphous polymer segment in the hybrid crystalline polyester resin is preferably 2% by mass or more and 20% by mass or less, more preferably 3% by mass or more and 15% by mass or less, further preferably 5% by mass or more and 10% by mass or less, and particularly preferably 7% by mass or more and 9% by mass or less from the viewpoint of imparting sufficient crystallinity to the hybrid crystalline polyester resin.

The resin component constituting the amorphous polymer segment is not particularly limited, and examples of the resin component include a vinyl polymer segment, an urethane polymer segment, and an urea polymer segment. Among these, a vinyl polymer segment is preferable for the reason that thermoplasticity can be easily controlled. Further, in a case where a vinyl polymer segment is used, by combining vinyl resin that is preferable among the amorphous resin so that vinyl resin accounts for the largest proportion, the compatibility with the vinyl resin is improved and a finer dispersion state can be maintained in the binder resin. This is preferable because the sharp melt property of the crystalline resin is more exerted during fixing. The vinyl polymer segment can be synthesized in a similar manner as the vinyl resin.

The vinyl polymer segment is not particularly limited as long as a vinyl compound is polymerized, and examples of the vinyl polymer segment include an acrylic ester polymer segment, a styrene-acrylic ester polymer segment, and an ethylene-vinyl acetate polymer segment. One kind of these may be used alone or two or more kinds of these may be used in combination.

Among the vinyl polymer segments described above, a styrene-acrylic acid ester polymer segment (also simply referred to as a styrene acrylic polymer segment) is preferable in consideration of plasticity during heat fixing. Therefore, hereinafter, the styrene acrylic polymer segment as the amorphous polymer segment will be described.

[Styrene Acrylic Polymer Segment]

The styrene acrylic polymer segment is formed by addition polymerization of at least a styrene monomer and a (meth)acrylic acid ester monomer. The styrene monomer here includes, in addition to styrene represented by the structural formula of $CH_2{=}CH{-}C_6H_5$, those having a structure having a publicly-known side chain or functional group in the styrene structure. Further, the (meth)acrylic acid ester monomer here includes an acrylic acid ester compound represented by $CH_2{=}CHCOOR$ (where R is an alkyl group), a methacrylic acid ester compound, as well as an ester compound having a publicly-known side chain or functional group in the structure of an acrylic acid ester derivative, a methacrylic acid ester derivative, or the like.

Hereinafter, specific examples of the styrene monomer and (meth)acrylic acid ester monomer capable of forming a styrene acrylic polymer segment will be shown. However, one that can be used to form the styrene acrylic polymer segment used in the present invention is not limited to those described below.

(Styrene Monomer)

Specific examples of the styrene monomer include, for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the like. These styrene monomers may be used alone or two or more kinds of these styrene monomers can be used in combination.

((Meth)Acrylic Acid Ester Monomer)

Further, specific examples of the (meth)acrylic acid ester monomer include, for example, acrylic acid monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate. Among these, a long-chain acrylic acid monomer is preferably used. Specifically, methyl acrylate, n-butyl acrylate, and 2-ethylhexyl acrylate are preferable.

Note that, in the present description, the term "(meth) acrylic acid ester monomer" is a general term for "acrylic acid ester monomer" and "methacrylic acid ester monomer", and, for example, "methyl (meth)acrylate" is a generic term for "methyl acrylate" and "methyl methacrylate".

These acrylic acid ester monomers or methacrylic acid ester monomers can be used alone or two kinds or more of these can be used in combination. That is, any of forming a copolymer using a styrene monomer and two or more kinds of acrylic acid monomers, forming a copolymer using a styrene monomer and two or more kinds of methacrylic ester monomers, and forming a copolymer using a styrene monomer together with an acrylic acid monomer and a methacrylic acid ester monomer can be performed.

The content of the constituting unit derived from the styrene monomer in the styrene acrylic polymer segment is preferably 40% by mass or more and 90% by mass or less with respect to the total amount of the styrene acrylic polymer segment, from the viewpoint of easily controlling the plasticity of the hybrid resin. Further, from a similar viewpoint, the content of the constituting unit derived from the (meth)acrylic acid ester monomer in the styrene acrylic polymer segment is preferably 10% by mass or more and 60% by mass or less with respect to the total amount of the styrene acrylic polymer segment.

Furthermore, the styrene acrylic polymer segment is preferably obtained by addition polymerization of a compound for chemically bonding to the crystalline polyester polymer segment in addition to the styrene monomer and the (meth) acrylic acid ester monomer. Specifically, it is preferable to use a compound that is ester bonded with a hydroxyl group [—OH] derived from a polyhydric alcohol component or a carboxyl group [—COOH] derived from a polyvalent carboxylic acid component contained in the crystalline polyester polymer segment. Accordingly, the styrene-acrylic polymer segment is preferably obtained by further polymerizing a compound that is addition-polymerizable to the styrene monomer and the (meth)acrylic acid ester monomer and has a carboxyl group [—COOH] or a hydroxyl group [—OH].

Examples of such compounds include compounds having a carboxyl group such as acrylic acid, methacrylic acid, maleic acid, itaconic acid, cinnamic acid, fumaric acid, maleic acid monoalkyl ester, itaconic acid monoalkyl ester and the like; and compounds having a hydroxyl group such as 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth)acrylate, 4-hydroxybutyl (meth)acrylate, polyethylene glycol mono (meth)acrylate, and the like.

The content of the constituting unit derived from the above compound in the styrene acrylic polymer segment is preferably 0.5% by mass or more and 20% by mass or less with respect to the total amount of the styrene acrylic polymer segment from the viewpoint of introducing a chemical bonding site with the crystalline polyester polymer segment into the styrene acrylic polymer segment.

The method for forming the styrene acrylic polymer segment is not particularly limited, and examples of the method include a method of polymerizing a monomer using a publicly-known oil-soluble or water-soluble polymerization initiator. Specific examples of the oil-soluble polymerization initiator include azo or diazo polymerization initiators and peroxide polymerization initiators described below.

(Azo or Diazo Polymerization Initiator)

Examples of the azo or diazo polymerization initiators include 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, azobisisobutyronitrile, and the like.

(Peroxide Polymerization Initiator)

Examples of the peroxide polymerization initiators include benzoyl peroxide, methyl ethyl ketone peroxide, diisopropyl peroxycarbonate, cumene hydroperoxide, t-butyl hydroperoxide, di-t-butyl peroxide, t-butyl peroxypivalate, dicumyl peroxide, 2,4-dichlorobenzoyl peroxide, lauroyl peroxide, 2,2-bis-(4,4-t-butylperoxycyclohexyl) propane, tris-(t-butylperoxy) triazine, and the like.

Further, in a case where resin particles are formed by an emulsion polymerization method, a water-soluble radical polymerization initiator can be used. Examples of the water-soluble radical polymerization initiator include persulfates such as potassium persulfate and ammonium persulfate, azobisaminodipropane acetate, azobiscyanovaleric acid and salts of azobiscyanovaleric acid, hydrogen peroxide, and the like.

(Method for Producing Hybrid Crystalline Polyester Resin)

The method for producing hybrid crystalline polyester resin contained in the binder resin according to the present invention is not particularly limited, as long as the method is capable of forming a polymer having a structure in which the crystalline polyester polymer segment and the amorphous polymer segment are chemically bonded. As a specific method for producing the hybrid crystalline polyester resin, for example, the hybrid crystalline polyester resin can be produced by first to third production methods described below.

(First Production Method)

The first production method is a method for producing the hybrid crystalline polyester resin by performing a polymerization reaction for synthesizing a crystalline polyester polymer segment in the presence of a previously synthesized amorphous polymer segment.

(Second Production Method)

The second production method is a method for producing the hybrid crystalline polyester resin by forming a crystalline polyester polymer segment and an amorphous polymer segment, and combining the segments.

(Third Production Method)

The third production method is a method for producing the hybrid crystalline polyester resin by performing a polymerization reaction for synthesizing an amorphous polymer segment in the presence of a crystalline polyester polymer segment.

Among the first to third production methods, the first production method is preferable because the hybrid crystalline polyester resin having a structure in which a crystalline polyester polymer chain (crystalline polyester resin chain) is grafted to an amorphous polymer chain (amorphous resin chain) can be easily synthesized and the production process can be simplified. In the first production method, since the crystalline polyester polymer segment is bonded after the amorphous polymer segment is formed in advance, the orientation of the crystalline polyester polymer segment tends to be uniform. Therefore, it is preferable from the viewpoint of reliably synthesizing the hybrid crystalline polyester resin suitable for the toner.

[Amorphous Resin]

The toner (white toner and color toner) according to the present invention preferably contains amorphous resin as the binder resin. The amorphous resin is resin that does not have the above-described crystallinity By containing the amorphous resin in the toner, the crystalline resin and the amorphous resin are compatible with each other at the time of heat fixing, and the low-temperature fixability of the toner is improved.

Amorphous resin is resin that does not have a melting point in the endothermic curve obtained when differential scanning calorimetry (DSC) of toner particles or amorphous resin is performed (that is, does not have the clear endothermic peak described above at the time of temperature increase) and has a relatively high glass transition temperature (Tg).

Note that Tg of the amorphous resin is preferably 35° C. or more and 80° C. or less, and more preferably 45° C. or more and 65° C. or less. In particular, the toner (white toner and color toner) has a core-shell structure because low-temperature fixability, hot offset resistance, and heat resistance can be maintained in a high balance. Furthermore, in a case where the core of the core-shell structure contains particles of a release agent (wax)-containing amorphous resin (for example, release agent-containing amorphous vinyl resin) having a three-layer structure, Tg of the amorphous resin constituting the outermost layer of the particles is preferably in the range of 55° C. or more and 65° C. or less from the viewpoint of maintaining the low-temperature fixability and the hot offset resistances in a high balance.

The glass transition temperature can be measured according to a method (DSC method) defined in ASTMD3418-82. For the measurement, a DSC-7 differential scanning calorimeter (manufactured by PerkinElmer Co., Ltd.), a TAC7/DX thermal analyzer controller (manufactured by PerkinElmer Co., Ltd.) or the like can be used.

The weight average molecular weight (Mw) of the amorphous resin is preferably 20000 or more and 150000 or less, and more preferably 25000 or more and 130000 or less, from the viewpoint of easy control of the plasticity of the amorphous resin. Further, the number average molecular weight (Mn) of the amorphous resin is preferably 5000 or more and 150000 or less, and more preferably 8000 or more and 70000 or less, from the viewpoint of easy control of the plasticity of the amorphous resin. The molecular weight of the amorphous resin can be measured in a similar manner as the method for measuring the molecular weight of the crystalline resin described above.

The mass ratio of the amorphous resin to the crystalline resin (amorphous resin/crystalline resin) is preferably 98/2 to 80/20, more preferably 95/5 to 80/20. When the mass ratio is in the above range, the crystalline resin is not exposed on the surface of the toner particles to be formed, or an exposed amount is extremely small even if the crystalline resin is exposed, and an amount of crystalline resin that is enough to achieve the low-temperature fixability can be introduced into the toner particles.

The amorphous resin is preferably used as the binder resin together with the above-described crystalline resin to constitute toner base particles. As the amorphous resin is contained, an advantage that appropriate fixed image strength and image gloss can be obtained and excellent charging characteristics can be imparted even under a temperature and humidity fluctuation environment can be obtained. The amorphous resin according to the present invention may be of one kind or in a state where a plurality of kinds are mixed. Further, examples of the amorphous resin preferably include amorphous vinyl resin, amorphous polyester resin, or hybrid amorphous polyester resin. These types of amorphous resins can be obtained by a publicly-known synthesis method or are commercially available. Further, in a case where the toner base particles according to the present invention have a core-shell structure, the amorphous vinyl resin and the crystalline polyester resin preferably constitute a core portion and the hybrid amorphous polyester resin constitutes the shell layer from the viewpoint of controllability of the dispersion state in the toner particles and charging characteristics.

One or more kinds of the amorphous resin may be used. Examples of the amorphous resin include amorphous polyester resin such as vinyl resin, urethane resin, urea resin, styrene-acrylic modified polyester resin, and the like. In the present embodiment, the amorphous resin preferably contains amorphous vinyl resin (also simply referred to as vinyl resin) from the viewpoint of easy control of thermoplasticity.

Hereinafter, the vinyl resin will be described.

In the present invention, the vinyl resin is preferably the main component in the binder resin. This is because as the vinyl resin is the main component in combination with the crystalline polyester resin, compatibility and incompatibility can be easily adjusted, the finely dispersed state of the crystalline polyester resin can be maintained in the binder resin, particularly in the vinyl resin as the main component, and the sharp melt property of the crystalline polyester resin is more exerted during fixing. From the above viewpoint, the content of the vinyl resin is preferably 50% by mass or more, more preferably 70% by mass or more, still more preferably 80% by mass or more, and particularly preferably 85% by mass or more of the binder resin. By using the vinyl resin as the main component (50% by mass or more of the binder resin), the compatibility with the crystalline resin can be easily adjusted, and the low-temperature fixability and the heat resistance can be maintained in a high balance Note that an upper limit of the content of the vinyl resin is not particularly limited, and is preferably 98% by mass or less, more preferably 95% by mass or less, and further preferably 93% by mass of the binder resin.

In the present invention, vinyl resin is preferably the main component in the binder resin and preferably contains amorphous polyester resin. This is because the vinyl resin is preferably the main component according to the reasons described above; however, in the adjustment of the compatibility with the crystalline resin, the compatibility is more easily adjusted when the amorphous polyester resin is contained. Further, in consideration of the core-shell structure, the amorphous polyester resin has better heat resistance, and the toner having a core-shell structure provided with a shell using the amorphous polyester resin is particularly excellent in both high heat resistance and low-temperature fixability. From the above viewpoint, the content of the amorphous polyester resin with respect to the toner base particles is preferably 2% by mass or more and 20% by mass or less, more preferably 3% by mass or more and 18% by mass or less, and further preferably 4% by mass or more and 15% by mass or less.

(Vinyl Resin)

In the present invention, the vinyl resin is, for example, a polymer of a vinyl compound, and examples the vinyl resin include acrylic ester resin, styrene-acrylic ester resins, and ethylene-vinyl acetate resin. One kind of these may be used alone or two or more kinds of these may be used in combination. Among these, styrene-acrylic ester resin (styrene acrylic resin) is preferred from the viewpoint of plasticity during heat fixing. Note that, for the styrene monomer and (meth)acrylic acid ester monomer used in the styrene acrylic resin, ones similar to those in the description in the sections "Styrene monomer" and "(Meth)acrylic acid ester monomer" may be used.

The styrene acrylic resin is formed by addition polymerization of at least a styrene monomer and a (meth)acrylic acid ester monomer. The styrene monomer includes a styrene derivative having a publicly-known side chain or functional group in the styrene structure in addition to styrene represented by the structural formula of $CH_2{=}CH{-}C_6H_5$.

The (meth)acrylic acid ester monomer includes an acrylic acid ester represented by $CH(R^1){=}CHCOOR^2$ (where $R^1$ represents a hydrogen atom or a methyl group, and $R^2$ represents an alkyl group having 1 to 24 carbons) and a methacrylic acid ester, as well as an acrylic acid ester derivative and a methacrylic acid ester derivative having a structure of these esters having a publicly-known side chain and a functional group.

Examples of the styrene monomer include, for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

Examples of the (meth)acrylic acid ester monomer include, for example, acrylic acid monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; methacrylic acid ester monomers such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate.

In the present description, "(meth)acrylic acid ester monomer" is a general term for "acrylic acid ester monomer" and "methacrylic acid ester monomer", and means one or both of them. For example, "methyl (meth)acrylate" means one or both of "methyl acrylate" and "methyl methacrylate".

The (meth)acrylic acid ester monomer may be of one kind or more. For example, any of forming a copolymer using a styrene monomer and two or more kinds of acrylic acid monomers, forming a copolymer using a styrene monomer and two or more kinds of methacrylic ester monomers, and forming a copolymer using a styrene monomer together with an acrylic acid monomer and a methacrylic acid ester monomer can be performed.

From the viewpoint of controlling the plasticity of the amorphous resin, the content of the constituting unit derived from the styrene monomer in the amorphous resin is preferably 40% by mass or more and 90% by mass or less. Further, the content of the constituting unit derived from the (meth)acrylic acid ester monomer in the amorphous resin is preferably 10% by mass or more and 60% by mass or less.

The amorphous resin may further contain a constituting unit derived from another monomer other than the styrene monomer and the (meth)acrylic acid ester monomer. Another monomer is preferably a compound that forms an ester bond with a hydroxy group (—OH) derived from polyhydric alcohol or a carboxy group (—COOH) derived from polyvalent carboxylic acid. That is, the amorphous resin is preferably addition-polymerizable with the styrene monomer and the (meth)acrylic acid ester monomer, and a polymer obtained by a compound having a carboxy group or a hydroxy group (amphoteric compound) that is further polymerized.

Examples of the amphoteric compound include compounds having a carboxyl group such as acrylic acid, methacrylic acid, maleic acid, itaconic acid, cinnamic acid, fumaric acid, maleic acid monoalkyl ester, itaconic acid monoalkyl ester and the like; and compounds having a hydroxyl group such as 2-hydroxyethyl (meth)acrylate, 2-hydroxypropyl (meth)acrylate, 3-hydroxypropyl (meth) acrylate, 2-hydroxybutyl (meth)acrylate, 3-hydroxybutyl (meth)acrylate, 4-hydroxybutyl (meth)acrylate, polyethylene glycol mono (meth)acrylate, and the like.

The content of constituting units derived from the amphoteric compound in the amorphous resin is preferably 0.5% by mass or more and 20% by mass or less.

The styrene acrylic resin can be synthesized by a method of polymerizing monomers using a publicly-known oil-soluble or water-soluble polymerization initiator. Examples of the oil-soluble polymerization initiators include azo or diazo polymerization initiators and peroxide polymerization initiators. Specifically, it is similar to the formation method of the styrene acrylic polymer segment and will be omitted from the description.

The weight average molecular weight (Mw) of the amorphous vinyl resin is preferably in the range of 20000 or more and 150000 or less, and the number average molecular weight (Mn) is preferably in the range of 5000 or more and 150000 or less from the viewpoint of both low-temperature fixability and hot offset resistance. The weight average molecular weight (Mw) and the number average molecular weight (Mn) can be measured in a similar manner to that in the case of the crystalline resin.

The glass transition temperature (Tg) of the amorphous vinyl resin is preferably in the range of 35° C. or more and 80° C. or less from the viewpoint of achieving both fixability and hot offset resistance. Note that the glass transition temperature can be measured in a similar manner to that in the case of the amorphous resin.

(Hybrid Amorphous Polyester Resin)

The binder resin according to the present invention preferably contains hybrid amorphous polyester resin from the viewpoint of obtaining appropriate compatibility when used in combination with amorphous vinyl resin, obtaining shape controllability of toner particles and image strength after fixing, and the like. In the present invention, the inclusion of the hybrid amorphous polyester resin facilitates adjustment of compatibility and incompatibility and crystallization. Note that the hybrid amorphous polyester resin can also be considered as modified amorphous polyester resin that is partially modified.

(Molecular Weight of Hybrid Amorphous Polyester Resin)

The weight average molecular weight (Mw) of the hybrid amorphous polyester resin is preferably 20000 or more and 50000 or less. This is because such a molecular weight facilitates adjustment of compatibility and incompatibility and crystallization. Further, the number average molecular weight (Mn) of the hybrid amorphous polyester resin is preferably 3000 or more and 12500 or less. To the measurement of the molecular weight, the method for measuring the molecular weight of the crystalline resin described above can be applied.

In the present invention, the hybrid amorphous polyester resin is resin in which an amorphous polyester polymer segment and an amorphous polymer segment other than the amorphous polyester, preferably an amorphous vinyl polymer segment, are chemically bonded.

The amorphous polyester polymer segment indicates a portion derived from amorphous polyester resin. That is, it indicates a molecular chain having the same chemical structure as that constituting the amorphous polyester resin. Further, the amorphous polymer segment other than the amorphous polyester indicates a portion derived from amorphous resin other than the amorphous polyester resin. Examples of the amorphous resin other than the amorphous polyester resin include vinyl resin such as styrene-acrylic resin, urethane resin, urea resin, and the like. One kind of the amorphous polymer segment other than the amorphous polyester may be used alone, or two or more kinds of the amorphous polymer segment may be used in combination. A more preferable amorphous vinyl polymer segment indicates a portion derived from amorphous vinyl resin. That is, it indicates a molecular chain having the same chemical structure as that constituting the amorphous vinyl resin.

The hybrid amorphous polyester resin may have any form, such as a block copolymer, a graft copolymer, or the like, as long as the hybrid amorphous polyester resin contains an amorphous polyester polymer segment and an amorphous polymer segment other than the amorphous polyester, particularly an amorphous vinyl polymer segment. However, the hybrid amorphous polyester resin is preferably a graft copolymer. As the hybrid amorphous polyester resin is the graft copolymer, the finally obtained toner has improved hot offset resistance and release separation while maintaining excellent low-temperature fixability.

Furthermore, from the above viewpoint, the amorphous polyester polymer segment preferably has a grafted structure with an amorphous polymer segment other than the amorphous polyester, particularly an amorphous vinyl polymer segment as a main chain. That is, the hybrid amorphous polyester resin is preferably a graft copolymer having an amorphous polymer segment other than the amorphous polyester as a main chain, particularly an amorphous vinyl polymer segment, and an amorphous polyester polymer segment as a side chain. By employing such a mode, the finally obtained toner has improved hot offset resistance and release separation while maintaining excellent low-temperature fixability.

In the present invention, in a case where the binder resin contains hybrid amorphous polyester resin, the content of the hybrid amorphous polyester resin with respect to the toner base particles is preferably 3% by mass or more and 20% by mass or less, and more preferably 5% by mass or more and 15% by mass or less.

(Amorphous Polyester Polymer Segment)

An amorphous polyester polymer segment is a portion derived from publicly-known polyester resin obtained by a polycondensation reaction of divalent or higher carboxylic acid (polyhydric carboxylic acid component) and divalent or higher alcohol (polyhydric alcohol component), and is a polymer segment where no clear endothermic peak is observed in DSC.

The amorphous polyester polymer segment is not particularly limited as long as it is as defined above. For example, for resin having a structure in which other components are copolymerized with the main chain of an amorphous polyester polymer segment and resin having a structure in which an amorphous polyester polymer segment is copolymerized with a main chain composed of other components, if the toner containing the resin does not have a clear endothermic peak as described above, the resin corresponds to the hybrid amorphous polyester resin having an amorphous polyester polymer segment in the present invention.

(Polyvalent Carboxylic Acid Component)

Examples of the polyvalent carboxylic acid component include oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, dicarboxylic acids such as diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, dodecenyl succinic acid; trimellitic acid, pyromellitic acid, naphthalenetricarboxylic acid, naphthalenetetracarboxylic acid, pyrenetricarboxylic acid, pyrenetetracarboxylic acid, and the like. These types of polyvalent carboxylic acid can be used alone or two or more types of them can be used in combination.

Among these, aliphatic unsaturated dicarboxylic acids such as fumaric acid, maleic acid, and mesaconic acid, aromatic dicarboxylic acids such as isophthalic acid and terephthalic acid, succinic acid, and trimellit, are preferably used from the viewpoint of easily obtaining the effect of the present invention.

(Polyhydric Alcohol Component)

Further, examples of the polyhydric alcohol component include divalent alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; trivalent or higher valent polyols such as glycerin, pentaerythritol, hexamethylol melamine, hexaethylol melamine, tetramethylol benzoguanamine, tetraethylol benzoguanamine, and the like. These polyhydric alcohol components can be used alone or two or more types of these can be mixed and used.

Among these, divalent alcohol such as an ethylene oxide adduct of bisphenol A and a propylene oxide adduct of bisphenol A are preferable from the viewpoint of easily obtaining the effect of the present invention.

The use ratio of the polyhydric carboxylic acid component to the polyhydric alcohol component is preferably 1.5/1 to 1/1.5, more preferably 1.2/1 to 1/1.2 in the equivalent ratio [OH]/[COOH of the hydroxyl group [OH] of the polyhydric alcohol component and the carboxyl group [COOH] of the polyhydric carboxylic acid component. When the use ratio of the polyhydric alcohol component and the polycarboxylic acid component is in the above range, controlling the acid value and molecular weight of the amorphous polyester resin becomes easier.

The method for forming the amorphous polyester polymer segment is not particularly limited, and the polymer segment can be formed by polycondensation (esterification) of the polyvalent carboxylic acid component and the polyhydric alcohol component using a publicly-known esterification catalyst.

The catalyst that can be used in the production of the amorphous polyester polymer segment is similar to the catalyst described in the above section (Crystalline resin), and will be omitted from the description here.

The polymerization temperature is not particularly limited, and is preferably 150° C. to 250° C. Further, the polymerization time is not particularly limited, and is preferably 0.5 to 10 hours. During the polymerization, the pressure in the reaction system may be reduced as necessary.

The content of the amorphous polyester polymer segment in the hybrid amorphous polyester resin is preferably 50% to by mass to 99.9% by mass, and more preferably 70% by mass to 95% by mass with respect to the total amount of the hybrid amorphous polyester resin. By setting the amount within the above range, it is possible to obtain an advantage that low-temperature fixing can be achieved while heat resistance is maintained, and the affinity with the amorphous vinyl resin can be balanced. Note that the structural component and content ratio of each polymer segment in the hybrid amorphous polyester resin can be identified by, for example, NMR measurement or methylation reaction Py-GC/MS measurement.

Note that a substituent such as a sulfonic acid group, a carboxy group, or a urethane group may be further introduced into the hybrid amorphous polyester resin. The substituent may be introduced in the amorphous polyester polymer segment or in the amorphous vinyl polymer segment described in detail below.

(Amorphous Polymer Segment)

With the amorphous polymer segment other than the amorphous polyester (particularly the amorphous vinyl polymer segment), the affinity of the amorphous vinyl resin and the hybrid amorphous polyester resin can be controlled in a case where the binder resin contains amorphous vinyl resin.

The inclusion of an amorphous polymer segment other than amorphous polyester in the hybrid amorphous polyester resin (and also in the toner) can be confirmed by identifying a chemical structure by using, for example, NMR measurement and methylation reaction Py-GC/MS measurement.

Further, the amorphous polymer segment other than amorphous polyester is a polymer segment that does not have a melting point and has a relatively high glass transition temperature (Tg) when differential scanning calorimetry (DSC) is performed on resin having the same chemical structure and molecular weight as the polymer segment. At this time, for the resin having the same chemical structure and molecular weight as the unit, the glass transition temperature (Tg) is preferably 35° C. or more and 80° C. or less, and more preferably 45° C. or more and 65° C. or less.

The amorphous polymer segment other than the amorphous polyester is not particularly limited as long as it is as defined above. For example, for resin having a structure in which other components are copolymerized with the main chain of an amorphous polymer segment other than amorphous polyester and resin having a structure in which an amorphous polymer segment other than amorphous polyester is copolymerized with a main chain composed of other components, if the toner containing the resin has the amorphous polymer segment as described above, the resin corresponds to the hybrid amorphous polyester resin having an amorphous polymer segment in the present invention.

The amorphous polymer segment other than the amorphous polyester is not particularly limited as long as it is one obtained by polymerizing a vinyl compound, one obtained by polymerizing a polyol component and an isocyanate component, or one obtained by polymerizing urea and formaldehyde. Among these, a preferable amorphous polymer segment is an amorphous vinyl polymer segment obtained by polymerizing a vinyl compound. For example, an acrylic ester polymer segment, a styrene-acrylic ester polymer segment, an ethylene-vinyl acetate polymer segment, and the like can be used. One kind of these may be used alone or two or more kinds of these may be used in combination.

Among the vinyl polymer segments described above, a styrene-acrylic acid ester polymer segment (styrene acrylic polymer segment) is preferable in consideration of plasticity during heat fixing. Further, since a preferable mode of the amorphous vinyl resin is styrene-acrylic resin, an amorphous vinyl polymer segment is also preferably a styrene acrylic polymer segment. By employing such a mode, an advantage that the affinity between the hybrid amorphous polyester resin and the amorphous vinyl resin is further improved and the shape controllability of the toner particles is facilitated is obtained.

The monomer and the forming method used for forming the styrene acrylic polymer segment, which are similar to the content of the section of "Styrene acrylic polymer segment" described in the section of the hybrid crystalline polyester resin, will be omitted from the description here.

The content of the amorphous polymer segment other than the amorphous polyester in the hybrid amorphous polyester resin is preferably 0.1% to 50% by mass, and more preferably 5% to 30% by mass with respect to the total amount of the hybrid amorphous polyester resin. With the content in the above range, in a case where amorphous vinyl resin is contained in the core portion, the affinity with the amorphous vinyl resin becomes higher, and the toner finally obtained is excellent in that excellent low-temperature fixability and hot offset resistance and heat resistance can be maintained in a higher balance A method for producing a hybrid amorphous polyester resin is not particularly limited as long as the method can form a polymer having a structure in which the amorphous polyester polymer segment is combined with an amorphous vinyl polymer segment preferable as an amorphous polymer segment other than the amorphous polyester. Specific examples of the method for producing the hybrid amorphous polyester resin include methods described below.

(1) A method of producing hybrid amorphous polyester resin, in which amorphous vinyl polymer segment is polymerized in advance, and a polymerization reaction is performed to form an amorphous polyester polymer segment in the presence of the amorphous vinyl polymer segment.

(2) A method of producing hybrid amorphous polyester resin, in which an amorphous polyester polymer segment and an amorphous vinyl polymer segment are formed, and then combined.

(3) A method of producing hybrid amorphous polyester resin, in which amorphous polyester polymer segment is polymerized in advance, and a polymerization reaction is performed to form an amorphous vinyl polymer segment in the presence of the amorphous polyester polymer segment.

Among the formation methods (1) to (3), the method (1) is preferable in that hybrid amorphous polyester resin having a structure in which an amorphous polyester polymer segment is grafted to an amorphous vinyl polymer segment can be easily formed and the production process can be simplified.

The toner (white toner and color toner) may contain an internal additive such as a release agent and a charge control agent; and an external additive such as inorganic fine particles, organic fine particles, and a lubricant, as necessary.

(Release Agent (Wax))

In the present embodiment, the toner preferably further contains a release agent (wax). A publicly-known one can be used for the release agent. Examples of the release agent include polyolefin wax such as polyethylene wax and polypropylene wax, branched hydrocarbon wax such as microcrystalline wax; long-chain hydrocarbon wax such as paraffin wax, sasol wax, and Fischer-Tropsch wax; dialkyl ketone wax such as distearyl ketone, carnauba wax, montan wax, behenyl behenate (behenyl behenate), trimethylolpropane tribehenate, pentaerythritol tetrabehenate, pentaerythritol diacetate dibehenate, glycerin tribehenate, 1,18-octadecanediol distearate, tristearyl trimellitic acid, distearyl maleate, ester wax such as fatty acid polyglycerol ester; amide-based wax such as ethylenediamine behenyl amide, and trimellitic acid tristearyl amide. The wax is easily compatible with the vinyl resin. For this reason, due to the plastic effect of the wax, it is possible to improve the sharp melt property of the toner and to obtain sufficient low-temperature fixability. The release agent is preferably ester wax (ester compound) from the viewpoint of obtaining sufficient low-temperature fixability, and more preferably a linear ester wax (A linear ester compound) from the viewpoint of achieving both heat resistance and low-temperature fixability. One kind of these release agents may be used alone or two kinds or more of them may be used in combination.

The melting point of the release agent is in a range of preferably 40° C. or more and 160° C. or less, more preferably 50° C. or more and 120° C. or less, and further preferably 70° C. or more and 80° C. or less from the viewpoint of obtaining sufficient high-temperature storage stability, low-temperature fixability, and releasability. By setting the melting point of the release agent within the above range, the heat-resistant storage property of the toner is ensured, and a stable toner image can be formed without causing a cold offset or the like even in a case where fixing is performed at a low temperature. The melting point of the release agent can be measured in a similar manner as the above-described method for measuring the peak top temperature (melting point) of the endothermic peak.

The content of the release agent in the toner is preferably in the range of 3% by mass or more and 15% by mass or less. Within such a range, there are effects of preventing hot offset and ensuring separability. If the content of the release agent is 3% by mass or more, the separability is improved, which is preferable. If the content of the release agent is 15% by mass or less, the heat resistance is improved, which is preferable.

(Charge Control Agent)

Various publicly-known compounds can be used as the charge control agent. Examples of the charge control agent include, for positive charging, a nigrosine-based electron-donating dye, metal salt of naphthenic acid or higher fatty acid, alkoxylated amine, quaternary ammonium salt, alkylamide, metal complex, pigment, and fluorine treatment activator; for negative charging, electron-accepting organic complex, chlorinated paraffin, chlorinated polyester, and sulfonylamine of copper phthalocyanine.

The content of the charge control agent is preferably 0.1 to 10 parts by mass, more preferably 0.5 to 5 parts by mass with respect to 100 parts by mass of the binder resin in the toner.

The toner (mainly toner base particles) may have what is called a single layer structure or a core-shell structure. The toner having the core-shell structure is preferable because the low-temperature fixability, the hot offset resistance and the heat resistance can be kept in a high balance by employing the core-shell structure. For example, the core portion includes at least binder resin and a colorant. Furthermore, other additives (internal additives) such as a release agent may be included as necessary. As an example, the shell layer includes amorphous resin. The core portion preferably includes binder resin including amorphous vinyl resin and crystalline polyester resin, a colorant, and further an internal additive such as a release agent. The shell layer is preferably composed of hybrid amorphous polyester resin.

The core-shell structure is not limited to a structure in which the shell layer completely covers the particle surface of the core portion, and includes one in which, for example, the shell layer does not completely cover the particle surface of the core portion, some parts of the particle surface of the core portion are exposed.

Further, from the viewpoint of improving the chargeability in a high-temperature and high-humidity environment, the toner (toner base particles) preferably has a mode, in which the crystalline resin is not exposed on the surface and contained in the inside of the toner base particles, and the amorphous resin is exposed on the surface of the toner base particles. Such a mode of the toner can be controlled by the timing of addition of each kind of resin when the toner base particles are produced by an emulsion aggregation method.

The mode (the cross-sectional structure of the core-shell structure and an existing position of the crystalline polyester resin) of the toner (toner base particles) can be checked by, for example, using a publicly-known means such as a transmission electron microscope (TEM) or a scanning probe microscope (SPM).

<Average Circularity of Toner Base Particles>

From the viewpoint of improving low-temperature fixability, the average circularity of the toner base particles is preferably in the range of 0.920 to 1.000, and more preferably in the range of 0.940 to 0.995.

Here, the average circularity is a value measured using "FPIA-2100" (manufactured by Sysmex Corporation). Specifically, the toner base particles are moistened in a surfactant solution, ultrasonic dispersion is performed for one minute, and, after dispersion, measurement is performed with an appropriate concentration of the HPF detection number of 4000 in a measurement condition HPF (high magnification imaging) mode using "FPIA-2100". The circularity is calculated by Equation described below.

Circularity=(Perimeter of a circle with the same projected area as the particle image)/(Perimeter of the particle projection image)

Further, the average circularity is an arithmetic average value obtained in a manner that the circularity of each particle is added and divided by the total number of particles measured.

<Particle Diameter of Toner Base Particles>

The toner base particles preferably have a volume-based median diameter (D50) of 3 to 10 μm. By setting the volume-based median diameter in the above range, reproducibility of fine lines, high image quality of photographic images can be achieved, and toner fluidity can be ensured. Here, the volume-based median diameter (D50) of the toner base particles is measured and calculated using, for example, an apparatus in which a computer system for data processing is connected to "Coulter Multisizer 3" (manufactured by Beckman Coulter, Inc.).

The volume-based median diameter of the toner base particles can be controlled by the concentration of an aggregating agent, an added amount of a solvent during the aggregation and fusion process at the time of the toner production described later, or the fusing time, and, furthermore, the composition of the resin component, and the like.

(External Additive)

From the viewpoint of improving charging performance, fluidity, and cleaning properties as the toner, particles such as publicly-known inorganic particles and organic particles and a lubricant can be added as external additives to the surface of the toner base particles.

Preferable inorganic particles include inorganic particles made from silica, sol-gel silica, titania, alumina, strontium titanate, or the like. These inorganic particles may be subjected to a hydrophobic treatment with a surface treatment agent such as a publicly-known silane coupling agent or silicone oil, as necessary. The size of the inorganic particles is preferably 2 nm or more and 50 nm or less, and more preferably 7 nm or more and 30 nm or less in terms of the number average primary particle diameter.

As the organic particles, homopolymers such as styrene and methyl methacrylate and organic particles of copolymers of these can be used. The size of the organic particles is preferably 10 nm or more and 2000 nm or less in terms of the number average primary particle diameter, and a particle shape of the organic particles is, for example, spherical.

Note that the number average primary particle diameter of inorganic particles or organic particles can be calculated using an electron micrograph. For example, the number average primary particle diameter can be obtained by image processing of an image taken with a transmission electron microscope. Alternatively, a 30000 times photograph of a toner sample is taken with a scanning electron microscope, and this photographic image is captured by a scanner. In the image processing analyzer LUZEX (registered trademark) AP (manufactured by NIRECO CORPORATION), external additives (inorganic particles and organic particles) present on the toner surface of the photographic image are binarized, and a horizontal Feret's diameter is calculated for 100 external additives per kind, and an average value of these may be used as the number average primary particle diameter. Preferably, the average particle diameter is obtained by measurement using a laser diffraction and scattering particle size distribution measuring apparatus (for example, LA-750 manufactured by Horiba, Ltd. and the like). The average particle diameter thus obtained is what is called a volume average particle diameter. Note that in a case where the average particle diameter of inorganic particles and organic particles is measured using an electron microscope and compared with the average particle diameter obtained from the measurement result by the laser diffraction and scattering type particle size distribution measuring apparatus, these values are confirmed to match each other, and the inorganic particles and organic particles are further confirmed to be not aggregated so that the average particle size is determined to be that of primary particles, the average particle diameter is determined to be the number average primary particle diameter of inorganic particles and organic particles. The number average primary particle diameter of the inorganic particles and organic particles can be adjusted by, for example, classification or mixing of classified products.

The lubricant is used for the purpose of further improving the cleaning property and the transfer property. Examples of the lubricant include salt of zinc, aluminum, copper, magnesium, and calcium stearate, and the like, salt of zinc, manganese, iron, copper, and magnesium oleate, and the like, salt of zinc, copper, magnesium, and calcium palmitate, and the like, salt of zinc, calcium, and the like of linoleic acid, and metal salt of higher fatty acid such as salt of calcium and the like. The size of the lubricant is preferably 0.3 μm or more and 20 μm or less, and more preferably 0.5 μm or more and 10 μm or less in terms of volume-based median diameter (volume average particle diameter). The volume-based median diameter of the lubricant may be determined according to JIS Z8825-1 (2013). Various kinds of these external additives may be used in combination.

The content of the external additive is preferably 0.1% to 10.0% by mass with respect to the entire toner particles. The external additive can be attached to the surface of the toner base particles using various publicly-known mixing devices such as a Turbula mixer, a Henschel mixer, a Nauta mixer, and a V-type mixer.

(Toner Production Method)

The method for producing the toner is not particularly limited, and examples of the method include publicly-known methods such as a kneading and pulverizing method, a suspension polymerization method, an emulsion aggregation method, a dissolution suspension method, a polyester elongation method, and a dispersion polymerization method.

Among these, an emulsion aggregation method is preferably employed from the viewpoint of the uniformity of particle diameters, the controllability of the shape, and the ease of forming the core-shell structure. Hereinafter, the emulsion aggregation method will be described.

<Emulsion Aggregation Method>

The emulsion aggregation method is a method, in which dispersion liquid of particles of resin (hereinafter also referred to as "resin particles") dispersed with a surfactant or a dispersion stabilizer is mixed with dispersion liquid of toner particle components such as colorant particles, aggregated by adding an aggregating agent until a desired toner particle diameter is obtained, and fusion between the resin particles is performed after or simultaneously with the aggregation, and shape control is performed, so that toner particles are formed.

Here, the resin particles may be composite particles formed of a plurality of layers having two or more layers made from resin having different compositions.

The resin particles can be produced, for example, by an emulsion polymerization method, a miniemulsion polymerization method, a phase inversion emulsification method, or the like, or can be produced by combining several production methods. In a case where an internal additive is contained in the resin particles, a miniemulsion polymerization method is preferably used.

In a case where an internal additive is contained in the toner particles, the resin particles may contain an internal additive, or dispersion liquid of internal additive particles consisting only of the internal additive is separately prepared and the internal additive particles may be aggregated together when the resin particles are aggregated.

Further, toner particles having a core-shell structure can also be obtained depending on an emulsion aggregation method. Specifically, toner particles having a core-shell structure can be obtained by first aggregating (fusing) a binder resin particle for a core portion and a colorant to produce a granular core portion, and then the binder resin particles for the shell layer are added to the dispersion liquid of the core portion to aggregate and fuse the binder resin particles for the shell layer on the surface of the core portion, so that a shell layer covering the surface of the core portion is formed.

In a case where the toner is produced by an emulsion aggregation method, a toner production method according to a preferred embodiment includes a process (hereinafter also referred to as a preparation process) (1) for preparing crystalline resin particle dispersion liquid and amorphous resin particle dispersion liquid as binder resin particle dispersion liquid, and colorant dispersion liquid, and a process (hereinafter referred to as aggregation and fusion process) (2) of mixing, aggregating, and fusing the crystalline resin particle dispersion liquid, the amorphous resin particle dispersion liquid, and the colorant dispersion liquid.

Hereinafter, each process will be explained in detail.

(1) Preparation Process

More specifically, the process (1) includes a crystalline resin particle dispersion liquid preparation process, an amorphous resin particle dispersion liquid preparation process, and a colorant dispersion liquid preparation process, and if necessary, a release agent dispersion liquid preparation process.

(1-1) Crystalline Resin Particle Dispersion Liquid Preparation Process and Amorphous Resin Particle Dispersion Liquid Preparation Process The crystalline resin particle dispersion liquid preparation process is a process of synthesizing the crystalline resin constituting the toner particles and dispersing the crystalline resin in the form of particles in an aqueous medium to prepare dispersion liquid of crystalline resin particles. Further, the amorphous resin particle dispersion liquid preparation process is a process of synthesizing the amorphous resin constituting the toner particles and dispersing the amorphous resin in the form of particles in an aqueous medium to prepare dispersion liquid of amorphous resin particles.

As a method for dispersing the crystalline resin in the aqueous medium, there is a method in which the crystalline resin is dissolved or dispersed in an organic solvent (solvent) to prepare oil phase liquid, the oil phase liquid is dispersed in the aqueous medium by phase inversion emulsification or the like, and, after oil droplets in a state of being controlled to have a desired particle diameter are formed, the organic solvent is removed. The method of dispersing the amorphous resin in the aqueous medium can be performed in a similar manner as the method of dispersing the crystalline resin in the aqueous medium.

The organic solvent (solvent) used for the preparation of the oil phase liquid is preferably one having a low boiling point and low solubility in water from the viewpoint of easy removal after formation of oil droplets. Specific examples include methyl acetate, ethyl acetate, methyl ethyl ketone, isopropyl alcohol, methyl isobutyl ketone, toluene, xylene and the like. One kind of these can be used alone or two or more kinds of these can be used in combination.

The amount of the organic solvent (solvent) used (in a case where two or more kinds are used, the total amount used) is preferably 1 to 300 parts by mass, more preferably 10 to 200 parts by mass, further preferably 25 to 100 parts by mass with respect to 100 parts by mass of resin.

Furthermore, ammonia, sodium hydroxide, or the like may be added to the oil phase liquid in order to dissociate the carboxyl group ions and stably emulsify the aqueous phase to facilitate the emulsification.

The amount of the aqueous medium used is preferably 50 to 2,000 parts by mass and more preferably 100 to 1,000 parts by mass with respect to 100 parts by mass of the oil phase liquid. By setting the amount of the aqueous medium used to the above range, the oil phase liquid can be emulsified and dispersed to a desired particle diameter in the aqueous medium.

A dispersion stabilizer may be dissolved in the aqueous medium, and a surfactant or resin particles may be added for the purpose of improving the dispersion stability of the oil droplets.

Examples of the dispersion stabilizer include inorganic compounds such as tricalcium phosphate, calcium carbonate, titanium oxide, colloidal silica, and hydroxyapatite. However, since it is necessary to remove the dispersion stabilizer from the obtained toner base particles, an acid- or alkali-soluble material such as tricalcium phosphate is preferably used, or, from the environmental viewpoint, a material that can be decomposed by enzyme is preferably used.

Examples of the surfactant include anionic surfactants such as alkylbenzene sulfonate, α-olefin sulfonate, phosphate ester, sodium alkyldiphenyl ether disulfonate, sodium polyoxyethylene lauryl ether sulfate, amine salt types such as alkylamine salt, amino-alcohol fatty acid derivatives, polyamine fatty acid derivatives, and imidazoline, cationic surfactants of quaternary ammonium salt such as alkyltrimethylammonium salt, dialkyldimethylammonium salt, alkyldimethylbenzylammonium salt, pyridinium salt, alkylisoquinolinium salt, benzethonium chloride, nonionic surfactants such as fatty acid amide derivatives, polyhydric alcohol derivatives, and the like, amphoteric surfactants such as alanine, dodecyldi (aminoethyl) glycine, di(octylaminoethyl) glycine, N-alkyl-N,N-dimethylammonium betaine, and the like, and anionic surfactants and cationic surfactants having a fluoroalkyl group can also be used.

Further, the resin particles for improving the dispersion stability are preferably those having a particle diameter of 0.5 to 3 μm, specifically, polymethyl methacrylate resin particles having a particle diameter of 1 μm and 3 μm, polystyrene resin particles having a particle diameter of 0.5 μm and 2 μm, polystyrene-acrylonitrile resin particles having a particle diameter of 1 μm, and the like.

Such emulsification and dispersion of the oil phase liquid can be performed using mechanical energy, and the disperser for performing the emulsification and dispersion is not particularly limited. Examples of the disperser include a low-speed shearing disperser, high-speed shearing disperser, a friction disperser, a high-pressure jet disperser, and an ultrasonic disperser, such as an ultrasonic homogenizer, and a high-pressure impact disperser ultimizer.

The removal of the organic solvent after the formation of the oil droplets can be performed by gradually raising the temperature of the entire dispersion liquid in which the crystalline resin particles are dispersed in the aqueous medium in a stirring state, providing strong stirring in a certain temperature range, and then operation, such as performing solvent removal. Alternatively, removal can be performed while the pressure is reduced using an apparatus such as an evaporator. As for the amorphous resin fine particles, the organic solvent can be removed after the formation of the oil droplets in a manner similar to that for the crystalline resin particles described above.

The average particle diameter of the crystalline resin particles (oil droplets) or the amorphous resin particles (oil droplets) in the crystalline resin particle dispersion liquid or the amorphous resin particle dispersion liquid prepared in the above manner is preferably 60 to 1000 nm, and more preferably 80 to 500 nm. Note that the average particle diameter of resin particles, colorant particles, release agents, and the like can be measured with a laser diffraction and scattering particle size distribution measuring apparatus (micro-track particle size distribution measuring apparatus "UPA-150" (manufactured by Nikkiso Co., Ltd.)). Note that the average particle diameter of these resin particles (oil droplets) can be controlled by the magnitude of mechanical energy during emulsification dispersion.

Further, the content of the crystalline resin particles or the amorphous resin particles in the crystalline resin particle dispersion liquid or the amorphous resin particle dispersion liquid is preferably in the range of 10% to 50% by mass, or more preferably in the range of 15% to 40% by mass with respect to 100% by mass of the dispersion liquid. Within such a range, the spread of the particle size distribution can be suppressed and the toner characteristics can be improved.

(1-2) Colorant Dispersion Liquid Preparation Process

This colorant dispersion liquid preparation process is a process of preparing dispersion liquid of colorant particles by dispersing a colorant in the form of particles in an aqueous medium.

The aqueous medium is as described in (1-1) described above, and in this aqueous medium, for the purpose of improving the dispersion stability, the surfactant and the resin particles shown in (1-1) above may be added.

Dispersion of the colorant can be performed using mechanical energy, and such a disperser is not particularly limited. As described above, examples of the disperser include a low-speed shearing disperser, high-speed shearing disperser, a friction disperser, a high-pressure jet disperser, and an ultrasonic disperser, such as an ultrasonic homogenizer, or a high-pressure impact disperser ultimizer.

Further, the content of the white colorant in the white colorant dispersion liquid is preferably in the range of 10% to 50% by mass, and more preferably in the range of 15% to 40% by mass. Within such a range, there is an effect of ensuring color reproducibility. Further, the content of the colorant for each color (for example, yellow, magenta, cyan, black, and the like) in the colorant dispersion liquid for each color is preferably in the range of 10% to 50% by mass, and more preferably in the range of 15% to 40% by mass Within such a range, there is an effect of ensuring color reproducibility.

(1-3) Release Agent Particle Dispersion Liquid Preparation Process

This release agent particle dispersion liquid preparation process is a process that is performed as necessary when toner particles containing a release agent are desired, and is a process in which the release agent is dispersed in particles in an aqueous medium to prepare dispersion liquid of release agent particles.

The aqueous medium is as described in (1-1) described above, and in this aqueous medium, for the purpose of improving the dispersion stability, the surfactant and the resin particles shown in (1-1) above may be added.

Dispersion of the release agent can be performed using mechanical energy, and such a disperser is not particularly limited. As described above, examples of the disperser include a low-speed shearing disperser, high-speed shearing disperser, a friction disperser, a high-pressure jet disperser, and an ultrasonic disperser, such as an ultrasonic homogenizer, a high-pressure impact disperser ultimizer, or a high-pressure homogenizer, and the like. In dispersing the release agent particles, heating may be performed as necessary.

The content of the release agent particles in the release agent particle dispersion is preferably in the range of 10% to 50% by mass, and more preferably in the range of 15% to 40% by mass. Within such a range, effects of preventing hot offset and ensuring separability can be obtained.

(2) Aggregation and Fusion Process

This aggregation and fusion process is a process of forming toner particles by adding and mixing crystalline resin particle dispersion liquid, amorphous resin particle dispersion liquid, and colorant dispersion liquid, and if necessary, other components such as release agent particle dispersion liquid, slowly aggregating the mixture while balancing the repulsive force of the particle surface by pH adjustment and the aggregation force by the addition of an aggregating agent made from an electrolyte, and aggregating the mixture while the average particle diameter and particle size distribution are controlled, and, at the same time, heated and stirred to fuse fine particles to perform shape control. This aggregation and fusion process can also be performed using mechanical energy or a heating means as required.

In the aggregation process, first, the obtained dispersion liquid is mixed to form a mixture, which is heated and aggregated at a temperature not higher than the glass transition temperature of the amorphous resin to form aggregated particles. Aggregated particles are formed by acidifying pH of the mixture under stirring. The value of pH is preferably in the range of 2 to 7, more preferably in the range of 2 to 6, and further preferably in the range of 2 to 5. At this time, it is preferable to use a flocculant.

As the flocculant used, a surfactant having a reverse polarity to the surfactant used for the dispersion liquid, inorganic metal salt, and a complex containing divalent or higher metal can be preferably used.

Examples of inorganic metal salt include metal salt such as sodium chloride, potassium chloride, lithium chloride, calcium chloride, barium chloride, magnesium chloride, zinc chloride, aluminum chloride, copper sulfate, magnesium sulfate, aluminum sulfate, manganese sulfate, and calcium nitrate, inorganic metal salt polymers such as polyaluminum chloride, polyaluminum hydroxide, polysilica iron, calcium polysulfide, and the like. Among these, aluminum salt and polyaluminum chloride are particularly preferable. In order to obtain sharper particle size distribution, the valence of the inorganic metal salt is preferably divalent rather than monovalent, trivalent rather than divalent, and tetravalent rather than trivalent.

As described above, the content of divalent or higher-valent metal ions in the toner can be controlled mainly by controlling pH of the mixture, the added amount and type of the flocculant in the present process.

When the aggregated particles have the desired particle diameter, additional crystalline resin particles and/or amorphous resin particles are further added, so that the toner (particles having a core-shell structure) having a structure in which the surface of the core aggregated particles is coated with the crystalline resin and/or amorphous resin can be produced. In the case of further addition, operation such as adding a flocculant or adjusting pH may be performed before the further addition.

During the aggregation, it is preferable to heat and increase the temperature. At this time, if the temperature becomes equal to higher than the fusing temperature due to heating and temperature increase, the fusion process also proceeds at the same time. The temperature increase rate is preferably 0.1° C./min to 5° C./min. The heating temperature (peak temperature) is preferably in the range of 40° C. to 100° C.

When the aggregated particles have the desired particle diameter, aggregation of various particles in the reaction system is stopped (hereinafter also referred to as an aggregation stop process). Aggregation stop is performed by adding an aggregation terminator made from a base compound for which pH adjustment can be performed in the direction of removal from the pH environment where the particle aggregation action is promoted in the aggregation process in order to suppress the particle aggregation action in the reaction system. The average particle diameter of the aggregated particles is not particularly limited, but is preferably about 4.5 to 7 μm.

In this aggregation stop process, it is preferable to adjust pH of the reaction system to 5 to 9.

Examples of the aggregation terminator (base compound) include publicly-known compounds having both functional groups or their salt, water-soluble polymers (polyelectrolytes), sodium hydroxide, potassium hydroxide and the like, such as alkali metal salt such as ethylenediaminetetraacetic acid (EDTA) and its sodium salt, gluconal, sodium gluconate, potassium citrate and sodium citrate, nitrotriacetate (NTA) salt, GLDA (commercially-available L-glutamic acid-N,N-diacetic acid), humic acid and fulvic acid, maltol and ethyl maltol, pentaacetic acid and tetraacetic acid, 3-hydroxy-2,2'-iminodisuccinic acid tetrasodium, and the like. In the aggregation stop process, stirring may be performed according to the aggregation process.

The fusion process is a process, in which, after the aggregation stop process or simultaneously with the aggregation process, the reaction system is heated to the desired fusing temperature, so that the particles constituting the aggregated particles are fused to fuse the aggregated particles, and the fused particles are formed.

The fusing temperature in this fusion process is preferably equal to or higher than the melting point of the crystalline resin, and the fusing temperature is preferably 0° C. to 20° C. higher than the melting point of the crystalline resin. The heating time is preferably as long as fusion is performed, and is preferably performed for about 0.5 to 10 hours.

In this aggregation and fusion process, in order to stably disperse each particle in the system, a surfactant similar to the surfactant used in the process of (1-1) Crystalline resin particle dispersion liquid preparation process/amorphous resin particle dispersion liquid preparation process described above may be added into an aqueous medium.

The addition ratio (mass ratio) of amorphous resin particles/crystalline resin particles in this aggregation and fusion process is preferably 1 to 100. Within such a range, the obtained toner has excellent hot offset resistance and excellent low-temperature fixability.

When other internal additives are introduced into the toner particles, a method of preparing internal additive particle dispersion liquid containing only the internal additive before the aggregation and fusion process, and mixing the dispersion liquid of the internal additive particles together with the crystalline resin particle dispersion liquid, the amorphous polyester resin particle dispersion liquid, and the colorant dispersion liquid in the aggregation and fusion process is preferable.

Cooling is performed after fusing to obtain fused particles. The cooling rate is preferably 1° C./min to 20° C./min.

When the toner is obtained by an emulsion aggregation method, it is preferable to have a circularity control process (3) for controlling the circularity of the toner after the aggregation and fusion process.

(3) Circularity Control Process

Specific examples of the circularity control processing include heating processing for heating the particles obtained in the aggregation and fusion process. Circularity can be controlled by a heating temperature and holding time. The circularity can be brought close to 1 by increasing the heating temperature or increasing the holding time.

The heating temperature in the circularity control processing is preferably 70° C. to 95° C. The circularity can be controlled by measuring the circularity of particles having a particle diameter of 2 μm or more with a circularity measuring device during heating and appropriately determining whether or not the desired circularity is obtained.

(4) Filtration and Washing Process

In this filtration and washing process, filtration processing in which the obtained dispersion liquid of toner particles is cooled to form cooled slurry and the toner particles are separated into solid and liquid using a solvent such as water from the cooled dispersion liquid of the toner particles, and washing processing in which deposits such as a surfactant is removed from the filtered toner particles (cake-like aggregate) are performed. Specific examples of the solid-liquid separation and washing method include a centrifugal separation method, a vacuum filtration method using an aspirator, Nutsche, and the like, a filtration method using a filter press, and the like, and these are not particularly limited. In this filtration and washing process, pH adjustment or pulverization may be performed as appropriate. Such operation may be repeated.

(5) Drying Process

In this drying process, the toner particles applied with the washing processing are applied with drying processing. Dryers used in this drying process include an oven, a spray dryer, a vacuum freeze dryer, a vacuum dryer, a stationary shelf dryer, a mobile shelf dryer, a fluidized bed dryer, a rotary dryer, a stirring dryer, and the like, and these are not specifically limited. Note that the moisture content measured by the Karl Fischer coulometric titration method in the dried toner particles is preferably 5% by mass or less, and more preferably 2% by mass or less.

Further, when the dried toner particles are aggregated by a weak interparticle attractive force to form an aggregate, the aggregate may be crushed. Here, as the crushing processing apparatus, a mechanical crushing apparatus such as a jet mill, a comb mill, a Henschel mixer, a coffee mill, a food processor, and the like can be used.

(6) External Additive Addition Process

This external additive addition process is a process of adding an external additive, such as charge control agents, various inorganic particles, organic particles, or lubricants to the dried toner particles for the purpose of improving fluidity, chargeability, cleaning properties, and the like. Examples of the apparatus used for adding the external additive include various publicly-known mixing apparatuses such as a Turbula mixer, a Henschel mixer, a Nauta mixer, and a V-type mixer, and a sample mill. Further, sieving classification may be performed as necessary in order to make the particle size distribution of the toner within an appropriate range.

(Developer)

For the above toner, a case where the toner is used as a one-component magnetic toner containing, for example, a magnetic material, a case where the toner is mixed with what is called a carrier and used as a two-component developer, or a case where a non-magnetic toner is used alone. The toner can be used preferably in any of these cases.

As the carrier constituting the two-component developer, magnetic particles made from conventionally publicly-known materials such as metal such as iron, ferrite, and magnetite, and alloys of these types of metal with metal such as aluminum and lead can be used, and ferrite particles are preferably used.

The carrier preferably has a volume average particle diameter of 15 to 100 μm, more preferably 25 to 60 μm.

As the carrier, a carrier further coated with a resin or what is called a resin dispersion type carrier in which magnetic particles are dispersed in the resin is preferably used. The resin composition for coating is not particularly limited, and for example, olefin resin, a cyclohexyl methacrylate-methyl methacrylate copolymer, styrene resin, styrene acrylic resin, silicone resin, ester resin, or fluorine resin is used. Further, the resin for constituting the resin dispersion type carrier is not particularly limited, and publicly-known resin can be used. For example, acrylic resin, styrene acrylic resin, polyester resin, fluorine resin, phenol resin, and the like can be used.

(Image Forming Method)

The image forming method of the present invention is an image forming method including a process of forming an image by transferring and fixing white toner and at least one color toner on a recording medium. That is, an image is formed by transferring and fixing a toner image made of white toner (white toner image) and a toner image made of color toner (color toner image) on a recording medium. At this time, there are a method of fixing a color toner image obtained by transferring color toner onto a recording medium after fixing a white toner image obtained by transferring white toner onto the recording medium, and a method of simultaneously fixing a white toner image obtained by transferring white toner onto a recording medium and a color toner image obtained by transferring a color toner image onto a recording medium. That is, as the fixing system, the white toner and the color toner may be transferred and fixed in a batch (1 pass), or image formation may be performed by repeating the transferring and fixing processes in stages (2 pass). Since the effects of the present invention can be obtained more efficiently and image formation is fast, the white toner image and the color toner image are preferably overlapped and fixed on the recording medium simultaneously to form an image. Further, as a fixed image, in order to enhance the effect of the present invention, the white toner layer is preferably a layer closer to the recording medium than the color toner layer (a mode in which the white toner constitutes an undercoat layer).

Preferably, the electrostatic latent image electrostatically formed on an image carrier is made to manifest as a developer is charged with a friction charging member in a developing device to obtain a toner image, the toner image is transferred onto a recording medium, and then the toner image transferred onto the recording medium is fixed onto a recording material by a contact heating type fixing processing, so that a visible image is obtained.

A preferable fixing method includes one of what is called a contact heating system. Examples of the contact heating system include a heat pressure fixing system, a heat roll fixing system, and a pressure contact heat fixing system in which fixing is performed by a rotating pressure member including a fixedly arranged heating body.

In the fixing method of the heat roll fixing system, usually, a fixing device configured with an upper roller provided with a heat source inside a metal cylinder made from iron or aluminum whose surface is coated with a fluororesin, and the like and a lower roller formed of silicone rubber or the like is used.

As the heat source, a linear heater is used, and a surface temperature of the upper roller is heated to about 120° C. to 200° C. by this heater. Pressure is applied between the upper roller and the lower roller, and the lower roller is deformed by the pressure, so that what is called a nip is formed in the deformed portion. A width of the nip is preferably 1 to 10 mm, more preferably 1.5 to 7 mm. The fixing linear velocity is preferably 40 mm/sec to 600 mm/sec.

(Recording Medium)

The recording medium (also referred to as a recording material, recording paper, and the like) may be a commonly used one, and is not particularly limited as long as it holds a toner image formed by a publicly-known image forming method using, for example, an image forming apparatus or the like. Examples of usable image supports include plain paper from thin paper to thick paper, high-quality paper, art paper, or coated printing paper such as coated paper, commercially available Japanese paper or postcard paper, OHP plastic films, fabrics, various resin materials used for what is called soft packaging, or resin films obtained by forming the resin materials into a film, labels, and the like.

(Image Forming Apparatus)

As for the configuration of the image forming apparatus itself, white toner and at least one color toner may be installed in a publicly-known image forming apparatus. As an image forming apparatus equipped with white toner and color toner, for example, JP 2002-328501 A can be cited.

Although the embodiment of the present invention has been described above, the present invention is not limited to the above modes, and various changes can be made.

EXAMPLES

The effects of the present invention will be described using examples and comparative examples. However, the present invention is not limited to these embodiments. In the examples, "parts" or "%" that may be used indicates "parts by mass" or "% by mass" unless otherwise specified. Further, unless otherwise specified, each operation is performed at room temperature (25° C.).

<Measurement and Calculation Method>

1. Peak Top Temperature of Endothermic Peak of White Toner and Color Toner

For the peak top temperature of the endothermic peak in the first temperature increasing process in the differential scanning calorimetry (DSC) measurement of white toner and color toner, DSC measurement was performed by differential scanning calorimetry using the differential scanning calorimeter "DSC-7" (manufactured by PerkinElmer Co., Ltd.) and the thermal analyzer controller "TAC7/DX" (manufactured by PerkinElmer Co., Ltd.).

Specifically, 0.5 mg of a measurement sample was sealed in an aluminum pan (KITNO.0219-0041), which was set in a sample holder of "DSC-7", temperature control of Heat (temperature increase)–cool (temperature decrease)–Heat (temperature increase) was performed under measurement conditions of a measurement temperature of 0 to 200° C., a temperature increase rate of 10° C./min, and a temperature decrease rate of 10° C./min, and analysis was performed based on data at 1st.Heat (the first temperature increasing process). However, an empty aluminum pan was used for measurement of a reference. In a case where there were a plurality of peaks, one having a highest peak height was defined as an endothermic peak of the toner.

2. Softening Point of White Toner and Color Toner

Toner softening points of the white toner and the color toner were measured by a measurement method described below.

First, under an environment of 20° C. and 50% RH, 1.1 g of a measurement sample was placed and leveled in a petri dish and left for 12 hours or more, and then was pressurized with a force of 3820 kg/cm' for 30 seconds with a molding machine "SSP-10A" (manufactured by Shimadzu Corporation) to manufacture a cylindrical molded sample with a diameter of 1 cm. Next, this molded sample was extruded from a hole (1 mm diameter by 1 mm) of a cylindrical die under conditions of a load of 196 N (20 kgf), a starting temperature of 60° C., a preheating time of 300 seconds, and a temperature increase rate of 6° C./min by a flow tester "CFT-500D" (manufactured by Shimadzu Corporation) under an environment of 24° C. and 50% RH by using a 1-cm diameter piston. An offset method temperature $T_{offset}$ measured with setting of an offset value of 5 mm by a melting temperature measurement method of a temperature increase method was taken as a softening point of the measurement sample.

3. Particle Diameter of Toner Base Particles

Measurement and calculation were performed using an apparatus in which a computer system (manufactured by Beckman Coulter, Inc.) mounted with data processing software "Software V3.51" was connected to Coulter Multisizer 3 (manufactured by Beckman Coulter, Inc.).

As a measurement procedure, 0.02 g of toner was conditioned with 20 ml of a surfactant solution (for example, a surfactant solution obtained by diluting neutral detergent containing a surfactant component 10 times with pure water for the purpose of dispersing the toner), and then ultrasonic dispersion was performed for one minute to prepare toner dispersion liquid. This toner dispersion liquid was pipetted into a beaker containing ISOTON (registered trademark) II (manufactured by Beckman Coulter, Inc.) in a sample stand until the displayed concentration of the measuring instrument reached 5% to 10%. By setting this concentration range, a reproducible measurement value can be obtained. In the measuring machine, the measurement particle count was set to 25000 and the aperture diameter was set to 100 μm, the frequency value was calculated by dividing the measurement range of 2.0 to 60 μm into 256, and a particle diameter of one that was 50% from a larger volume integrated fraction was defined as a volume-based median diameter (volume D50% diameter).

4. Toner Circularity

As the circularity of the toner, a value measured using "FPIA (registered trademark)-2100" (manufactured by Sysmex Corporation) was used. Specifically, the sample was blended into a solution of a surfactant in commercially available special sheath liquid and was dispersed by performing ultrasonic dispersion for one minute, and then "FPIA (registered trademark)-2100" was used to perform measurement at an appropriate density of the number of HPF detections of 3000 to 10000 in the measurement condition HPF (high magnification imaging) mode. Within this range, a reproducible identical measurement value can be obtained. The circularity defined by Equation below was measured.

Circularity=(Perimeter of a circle with the same projected area as the particle image)/(Perimeter of the particle projection image)

Further, the average circularity is a value obtained in a manner that the circularity of each particle is added and divided by the total number of particles.

5. Endothermic Peak Temperature (Melting Point: Tm) of Crystalline Polyester Resin and Glass Transition Temperature (Tg) of Amorphous Resin The endothermic peak temperature of the crystalline polyester resin and the glass transition temperature (Tg) of the amorphous resin were obtained using a differential scanning calorimeter (manufactured by Shimadzu Corporation: DSC-60A) in accordance with ASTM D3418. The temperature of the detection part of this apparatus (DSC-60A) was corrected using the melting points of indium and zinc, and the heat quantity was corrected using the heat of fusion of indium. For the sample, an aluminum pan was used, an empty pan was set for comparison, and the temperature was increased at a rate of 10° C./min, held at 200° C. for 5 minutes, decreased at a rate of −10° C./min using liquid nitrogen from 200° C. to 0° C., held at 0° C. for 5 minutes, and increased again from 0° C. to 200° C. at 10° C./min. The analysis was performed from the endothermic curve at the second temperature increase, and the onset temperature was set to Tg for the amorphous resin, and the maximum peak was set to the endothermic peak temperature (melting point: Tm) for the crystalline polyester resin.

6. Softening Point of Crystalline Polyester Resin and Amorphous Resin

The softening points of the crystalline polyester resin and the amorphous resin were measured in a similar manner to the method for measuring the softening points of the white toner and the color toner.

7. Weight Average Molecular Weight (Mw) of Crystalline Polyester Resin and Amorphous Resin The weight average molecular weights of the crystalline polyester resin and the amorphous resin were measured as described below.

First, the sample was added to tetrahydrofuran (THF) to a concentration of 0.1 mg/mL, heated to 40° C. so that the sample was completely dissolved, and then treated with a membrane filter with pore size of 0.2 μm, so that a sample solution (sample) was prepared. After the above, measurement was performed under conditions described below. Specifically, using a GPC device HLC-8220GPC (manufactured by Tosoh Corporation) and a column "TSKgelSuperH3000" (manufactured by Tosoh Corporation), while a column temperature was kept at 40° C., THF as a carrier solvent (eluent) was allowed to flow at a flow rate of 0.6 mL/min. Together with the carrier solvent, 100 μL of the prepared sample solution was injected into the GPC device, and the sample was detected using a differential refractive index detector (RI detector). Then, the molecular weight distribution of the sample was calculated using a calibration curve measured using 10 points of monodisperse polystyrene standard particles. Further, in the data analysis, in a case where the peak due to the filter was confirmed, the data analyzed by setting the baseline before the peak was taken as the molecular weight of the sample.

Measurement model: GPC device HLC-8220GPC manufactured by Tosoh Corporation

Column: "TSKgelSuperH3000" manufactured by Tosoh Corporation

Eluent: THF

Temperature: Column thermostat 40.0° C.

Flow rate: 0.6 ml/min

Concentration: 0.1 mg/mL (0.1 wt/vol %)

Calibration curve: Standard polystyrene sample manufactured by Tosoh Corporation Injection amount: 100 μl Solubility: Complete dissolution (heated to 40° C.)

Pretreatment: Filtration with 0.2-μm filter

Detector: differential refractometer (RI).

8. Average Particle Diameter of Resin Particles, Colorant Particles, Release Agents, and the Like The average particle diameter of resin particles, colorant particles, release agents, and the like was measured with a laser diffraction and scattering particle size distribution measuring apparatus (micro-track particle size distribution measuring apparatus "UPA-150" (manufactured by Nikkiso Co., Ltd.)).

<Synthesis of Crystalline Resin (C1)>

A raw material monomer and a radical polymerization initiator of the addition polymerization type polymer segment (styrene acrylic polymer segment: StAc) described below containing both reactive monomers were placed in a dropping funnel.

styrene 36.0 parts by mass n-Butyl acrylate 13.0 parts by mass acrylic acid 2.0 parts by mass polymerization initiator (di-t-butyl peroxide) 7.0 parts by mass Further, the raw material monomers of polycondensation polymer segments (crystalline polyester polymer segments: CPEs) described below were placed in a four-necked flask equipped with a nitrogen introduction tube, a dehydration tube, a stirrer, and a thermocouple, and heated to 170° C. and dissolved.

tetradecanedioic acid 440 parts by mass 1,4-butanediol 153 parts by mass

Next, the raw material monomer of the addition polymerization polymer segment (StAc) was dropped over 90 minutes with stirring, and, after aged for 60 minutes, the unreacted addition polymerization monomer was removed under reduced pressure (8 kPa). Note that the amount of monomer removed at this time was extremely small with respect to the raw material monomer ratio of the polymer segment (StAc).

After the above, 0.8 parts by mass of $Ti(OBu)_4$ was added as an esterification catalyst, the temperature was increased to 235° C., and the reaction was performed under normal pressure (101.3 kPa) for five hours and further under reduced pressure (8 kPa) for one hour.

Next, after cooling to 200° C., hybrid crystalline polyester resin (C1) was obtained by reacting under reduced pressure (20 kPa) for one hour.

The obtained hybrid crystalline polyester resin (C1) was resin in a form in which crystalline polyester polymer segments (CPEs) were grafted to styrene acrylic polymer segments (StAc). Further, the hybrid crystalline polyester resin (C1) had a weight average molecular weight (Mw) of 24,500 and a melting point (Tm) of 75° C. The softening point (Tsp) was 88° C.

<Synthesis of Crystalline Resin (C2)>

Into a reaction vessel equipped with a stirrer, a nitrogen inlet tube, a temperature sensor, and a rectification column, 275 parts by mass of sebacic acid and 275 parts by mass of 1,12-dodecanediol were charged, and the temperature of the reaction system was increased to 190° C. over one hour, and the reaction system was confirmed to be uniformly stirred.

After the above, 0.3 part by mass of $Ti(OBu)_4$ was added as a catalyst, and the temperature of the reaction system was increased from the same temperature (190° C.) to 240° C. over six hours while the generated water was distilled off, and, further, the dehydration condensation reaction is continued for six hours while the temperature is maintained at 240° C. to carry out the polymerization reaction, so that crystalline polyester resin (c2) was obtained.

Subsequently, the obtained crystalline polyester resin (c2) was transferred into a reaction vessel equipped with a cooling tube, a stirrer, and a nitrogen introducing tube, 300 parts by mass of ethyl acetate and 44 parts by mass of hexamethylene diisocyanate were added, and the reaction was carried out at 80° C. for five hours under a nitrogen stream. Next, ethyl acetate was distilled off under reduced pressure to obtain hybrid crystalline polyester resin (C2).

The obtained hybrid crystalline polyester resin (C2) was resin in which a urethane polymer segment and a crystalline polyester polymer segment (CPEs) were chemically bonded. The hybrid crystalline polyester resin (C2) had a weight average molecular weight (Mw) of 52,000 and a melting point (Tm) of 79° C. The softening point (Tsp) was 92° C.

<Synthesis of Crystalline Resin (C3)>

Into a reaction vessel equipped with a stirrer, a nitrogen inlet tube, a temperature sensor, and a rectification column, 200 parts by mass of dodecanedioic acid and 102 parts by mass of 1,6-hexanediol were charged, and the temperature of the reaction system was increased to 190° C. over one hour, and the reaction system was confirmed to be uniformly stirred.

After the above, 0.3 part by mass of $Ti(OBu)_4$ was added as a catalyst, and the temperature of the reaction system was increased from the same temperature (190° C.) to 240° C. over six hours while the generated water was distilled off, and, further, the dehydration condensation reaction is continued for six hours while the temperature is maintained at 240° C. to carry out the polymerization reaction, so that crystalline polyester resin [C3] was obtained.

The obtained crystalline polyester resin [C3] had a weight average molecular weight (Mw) of 14,500 and a melting point of 70° C. The softening point (Tsp) was 80° C.

<Synthesis of Crystalline Resin (C4)>

Hybrid crystalline polyester resin (C4) was obtained in a similar manner in the synthesis of the crystalline resin (C1) except that the monomer used was changed from 1,4-butanediol to 1,6-hexanediol.

After the above, 0.8 parts by mass of $Ti(OBu)_4$ was added as an esterification catalyst, the temperature was increased to 235° C., and the reaction was performed under normal pressure (101.3 kPa) for five hours and further under reduced pressure (8 kPa) for one hour.

Next, after cooling to 200° C., hybrid crystalline polyester resin (C5) was obtained by reacting under reduced pressure (20 kPa) for one hour.

The obtained hybrid crystalline polyester resin (C5) was resin in a form in which crystalline polyester polymer segments (CPEs) were grafted to styrene acrylic polymer segments (StAc). Further, the hybrid crystalline polyester resin (C5) had a weight average molecular weight (Mw) of 41,500 and a melting point (Tm) of 66° C. The softening point (Tsp) was 78° C.

The physical properties of the crystalline resins (C1) to (C5) obtained by the above synthesis are shown in Table 1 below.

TABLE 1

| Crystalline resin | Other polymer segments that are hybrid (HB) with the crystalline polyester polymer segments (CPEs) (represented as "CPEs HB" in Table 3) | Tsp (° C.) | Tm (° C.) | Mw |
|---|---|---|---|---|
| C1 | Styrene acrylic polymer segments (StAc) | 88 | 75 | 24,500 |
| C2 | Urethane polymer segment | 92 | 79 | 25,000 |
| C3 | None | 80 | 70 | 14,500 |
| C4 | Styrene acrylic polymer segments (StAc) | 75 | 85 | 29,500 |
| C5 | Styrene acrylic polymer segments (StAc) | 78 | 66 | 41,500 |

The obtained hybrid crystalline polyester resin (C4) was resin in a form in which crystalline polyester polymer segments (CPEs) were grafted to styrene acrylic polymer segments (StAc). Further, the hybrid crystalline polyester resin (C4) had a weight average molecular weight (Mw) of 29,500 and a melting point (Tm) of 85° C. The softening point (Tsp) was 75° C.

<Synthesis of Crystalline Resin (C5)>

A raw material monomer and a radical polymerization initiator of the addition polymerization type polymer segment (styrene acrylic polymer segment: StAc) described below containing both reactive monomers were placed in a dropping funnel.

styrene 66.5 parts by mass n-Butyl acrylate 23.5 parts by mass acrylic acid 3.9 parts by mass polymerization initiator (di-t-butyl peroxide) 13.7 parts by mass Further, the raw material monomers of polycondensation polymer segments (crystalline polyester polymer segments: CPEs) described below were placed in a four-necked flask equipped with a nitrogen introduction tube, a dehydration tube, a stirrer, and a thermocouple, and heated to 170° C. and dissolved.

dodecanedioic acid 250 parts by mass 1,6-hexanediol 128 parts by mass

Next, the raw material monomer of the addition polymerization polymer segment (StAc) was dropped over 90 minutes with stirring, and, after aged for 60 minutes, the unreacted addition polymerization monomer was removed under reduced pressure (8 kPa). Note that the amount of monomer removed at this time was extremely small with respect to the raw material monomer ratio of the polymer segment (StAc).

<Preparation of Crystalline Resin Dispersion Liquid (C1)>

A solution was prepared by dissolving 72 parts by mass of the crystalline polyester resin (C1) obtained above in 72 parts by mass of methyl ethyl ketone by stirring at 70° C. for 30 minutes. Next, 2.5 parts by mass of an aqueous sodium hydroxide solution of 25% by mass was added while the solution was stirred. Next, an aqueous solution in which sodium polyoxyethylene lauryl ether sulfate was dissolved in 250 parts by mass of ion-exchanged water so as to have a concentration of 1% by mass was dropped over 70 minutes to obtain an emulsion.

Next, while the temperature of this emulsion is maintained at 70° C., the emulsion was stirred for three hours under pressure reduced to 15 kPa (150 mbar) using a diaphragm type vacuum pump "V-700" (manufactured by BUCHI Labortechnik AG) to distill methyl ethyl ketone, and "dispersion liquid (C1) of crystalline polyester resin (C1)" in which particles of the crystalline polyester resin (C1) were dispersed was produced.

At this time, the particles contained in the dispersion liquid (C1) were measured with a laser diffraction particle size distribution analyzer "LA-750 (manufactured by HORIBA)", and as a result, the volume average particle diameter was 200 nm.

<Preparation of Crystalline Resin Dispersion Liquid (C2) to (C5)>

The crystalline resin dispersion liquid (C2) to (C5) was prepared in a similar manner to the preparation of the crystalline resin dispersion (C1), except that the crystalline resin (C1) used was changed to the crystalline resins (C2) to (C5). The volume average particle diameters of the particles contained in the dispersion liquid (C2) to (C5) were measured in a similar manner to the particles contained in the dispersion liquid (C1), and were found to be 210 nm, 190 nm, 225 nm, and 175 nm in this order.

<Preparation of Amorphous Resin Particle Dispersion Liquid (B1)>

(1) First Stage Polymerization

In a 5-L reaction vessel equipped with a stirrer, a temperature sensor, a cooling tube, and a nitrogen introduction device, 8 parts by mass of sodium dodecyl sulfate and 3000 parts by mass of ion-exchanged water were charged, and the internal temperature of the reaction vessel was increased to 80° C. while the solution was stirred at a stirring speed of 230 rpm under a nitrogen stream. After the temperature increase, an aqueous solution in which 10 parts by mass of potassium persulfate was dissolved in 200 parts by mass of ion-exchanged water was added to the obtained mixture, and the temperature of the obtained mixture was again set to 80° C. After the monomer mixture 1 having a composition described below was dropped to the mixed liquid over one hour, the mixture was heated at 80° C. for 2 hours and stirred to polymerize, and dispersion liquid (b1) of resin particles was prepared.

(Monomer Mixture 1)

styrene 480 parts by mass n-butyl acrylate 250 parts by mass methacrylic acid 68 parts by mass (2) Second Stage Polymerization In a 5 L reaction vessel equipped with a stirrer, a temperature sensor, a cooling tube, and nitrogen introducing device, a solution prepared by dissolving 7 parts by mass of polyoxyethylene (2) sodium dodecyl ether sulfate in 3000 parts by mass of ion-exchanged water was charged. After the solution was heated to 80° C., 80 parts by mass of resin particle dispersion (b1) (in terms of solid content), a monomer mixture 2 obtained by dissolving a monomer having a composition described below and a release agent at 90° C. was added, and then mixed and dispersed for one hour with a mechanical disperser "CLEARMIX" (M Technique Co., Ltd., "CLEARMIX" is a registered trademark of the company) having a circulation passage to prepare dispersion liquid containing emulsified particles (oil droplets). Behenyl behenate described below is a release agent, and has a melting point at 73° C.

(Monomer Mixture 2)

styrene 285 parts by mass n-butyl acrylate 95 parts by mass methacrylic acid 20 parts by mass n-Octyl-3-mercaptopropionate 8 parts by mass behenyl behenate 190 parts by mass Next, an initiator solution in which 6 parts by mass of potassium persulfate was dissolved in 200 parts by mass of ion-exchanged water was added to the dispersion liquid, and the resulting dispersion liquid was heated and stirred at 84° C. for one hour to perform polymerization, so that dispersion liquid (b2) of resin particles was prepared.

(3) Third Stage Polymerization

Furthermore, after 400 parts by mass of ion-exchanged water was added to the dispersion liquid (b2) of resin particles and the dispersion liquid was mixed sufficiently, a solution in which 11 parts by mass of potassium persulfate was dissolved in 400 parts by mass of ion-exchanged water was added to the resulting dispersion liquid, and a monomer mixture 3 having a composition described below was dropped over one hour under the temperature condition of 82° C. After completion of dropping, the dispersion liquid was polymerized by heating and stirring for two hours, and then cooled to 28° C. to prepare amorphous resin particle dispersion liquid (B1) containing vinyl resin (styrene acrylic resin).

(Monomer Mixture 3)

styrene 307 parts by mass n-butyl acrylate 147 parts by mass methacrylic acid 52 parts by mass n-Octyl-3-mercaptopropionate 8 parts by mass When the physical properties of the obtained amorphous resin particle dispersion (B1) were measured, the volume-based median diameter (d50) of the amorphous resin particles was 220 nm, the glass transition temperature (Tg) was 46° C., and the weight average molecular weight (Mw) was 32000.

<Preparation of Amorphous Resin Particle Dispersion Liquid (B2)>

The monomer mixture 1 having a composition described below containing amphoteric compound (acrylic acid) was placed in a dropping funnel. Note that di-t-butyl peroxide is a polymerization initiator.

(Monomer Mixture 1)

styrene 80 parts by mass n-butyl acrylate 20 parts by mass acrylic acid 10 parts by mass di-t-butyl peroxide 16 parts by mass Further, the raw material monomers of polycondensation segments (amorphous polyester polymer segments) described below were placed in a four-necked flask equipped with a nitrogen introduction tube, a dehydration tube, a stirrer, and a thermocouple, and heated to 170° C. and dissolved.

bisphenol A ethylene oxide 2-mole adduct 59.1 parts by mass bisphenol A propylene oxide 2-mole adduct 281.7 parts by mass terephthalic acid 63.9 parts by mass succinic acid 48.4 parts by mass Next, the monomer mixture 1 was dropped into the obtained solution over 90 minutes with stirring, and after aging for 60 minutes, an unreacted monomer among the components of the monomer mixture 1 was removed from the four-necked flask under reduced pressure (8 kPa).

After the above, 0.4 part by mass of $Ti(OBu)_4$ as an esterification catalyst was charged into a four-necked flask, a temperature of the mixture in the four-necked flask was increased to 235° C., and reaction was carried out for five hours under normal pressure (101.3 kPa) and further for one hour under reduced pressure (8 kPa). Next, after cooling to 200° C. and reaction was carried out under reduced pressure (20 kPa), the solvent was removed to obtain amorphous resin (B2) which is hybrid amorphous polyester resin modified with vinyl resin. The obtained amorphous resin (B2) had a weight average molecular weight (Mw) of 24000, an acid value of 16.2 mgKOH/g, and a glass transition temperature (Tg) of 60° C. The softening point (Tsp) was 105° C.

A mixture was obtained by dissolving 100 parts by mass of amorphous resin (B2) in 400 parts by mass of ethyl acetate (manufactured by KANTO CHEMICAL CO., INC.) and mixing the amorphous resin with 638 parts by mass of sodium lauryl sulfate solution having a concentration of 0.26% by mass prepared in advance.

The obtained mixture was ultrasonically dispersed with an ultrasonic homogenizer "US-150T" (manufactured by NIHONSEIKI KAISHA LTD.) for 30 minutes under the condition of V-LEVEL of 300 μA while stirring.

After the above, the mixture was stirred for three hours under reduced pressure using a diaphragm vacuum pump "V-700" (manufactured by BUCHI Labortechnik AG) in a state heated to 40° C. to completely remove ethyl acetate. In this manner, amorphous resin particle dispersion liquid (B2) having a solid content of 13.5% by mass was prepared. The volume-based median diameter (d50) of the resin particles in the dispersion liquid was 160 nm.

<Synthesis of Amorphous Resin (B3)>

Amorphous resin (B3) was obtained in a similar manner to the preparation of the amorphous resin particle dispersion liquid (B2), except that the raw material monomer of the amorphous polyester polymer segment was as follows:

bisphenol A ethylene oxide 2-mole adduct 204.5 parts by mass bisphenol A propylene oxide 2-mole adduct 204.5 parts by mass fumaric acid 16.0 parts by mass isophthalic acid 80.0 parts by mass. The obtained amorphous resin (B3) had a weight average molecular weight (Mw) of 280000, an acid value of 31 mgKOH/g, and a glass transition point (Tg) of 60° C. The softening point (Tsp) was 125° C.

<Synthesis of Amorphous Resin (B4)>

Amorphous resin (B4) was obtained in a similar manner to the preparation of the amorphous resin particle dispersion liquid (B2), except that the raw material monomer of the amorphous polyester polymer segment was as follows:

bisphenol A propylene oxide 2-mole adduct 340.8 parts by mass trimellitic anhydride 64.2 parts by mass isophthalic acid 64.2 parts by mass. The obtained amorphous resin (B4) had a weight average molecular weight (Mw) of 84000, an acid value of 31 mgKOH/g, and a glass transition point (Tg) of 67° C. The softening point (Tsp) was 140° C.

The physical properties of the amorphous resins (B1) to (B4) obtained by the above synthesis are shown in Table 2 below.

TABLE 2

| Amorphous resin | Kind of resin | Tg (° C.) | Tsp (° C.) | Mw |
|---|---|---|---|---|
| B1 | Styrene acrylic resin (St-Ac resin) | 46 | — | 32,000 |
| B2 | Hybrid amorphous polyester resin | 60 | 105 | 24,000 |
| B3 | Hybrid amorphous polyester resin | 60 | 125 | 280,000 |
| B4 | Hybrid amorphous polyester resin | 67 | 140 | 84,000 |

In the column of "Tsp (° C.)" of the amorphous resin (B1) in Table 2, "-" indicates that it does not have a softening point (Tsp).

<Preparation of Colorant Particle Dispersion Liquid (Cy)> sodium dodecyl sulfate 90 parts by mass

C.I. Pigment Blue 15: 3 200 parts by mass ion-exchanged water 1600 parts by mass A solution in which the above components were mixed was sufficiently dispersed with Ultra Turrax T50 (manufactured by IKA), and then treated with an ultrasonic disperser for 20 minutes to prepare cyan colorant particle dispersion liquid (Cy). With respect to the obtained cyan colorant particle dispersion liquid (Cy), the volume-based median diameter of the colorant particles was 180 nm.

<Preparation of Toner Cy1 and Developer Cy-1>

(Aggregation and Fusion Process and Aging Process)

Into a reaction vessel equipped with a stirrer, a temperature sensor, and a cooling tube, 288 parts by mass of the amorphous resin particle dispersion liquid (B1) (in terms of solid content) and 2000 parts by mass of ion-exchanged water were added, and 5 mol/liter of sodium hydroxide aqueous solution was further added to adjust pH of the dispersion liquid in the reaction vessel to 10 (measurement temperature: 25° C.).

To the dispersion liquid, 30 parts by mass of a colorant dispersion liquid (in terms of solid content) was added. Next, an aqueous solution in which 30 parts by mass of magnesium chloride as a flocculant was dissolved in 60 parts by mass of ion-exchanged water was added to the dispersion liquid over 10 minutes at 30° C. with stirring. The obtained mixture was heated to 80° C., and 36 parts by mass of crystalline resin particle dispersion liquid (C1) (in terms of solid content) was added to the mixture over 10 minutes to promote aggregation.

The particle diameter of the particles associated in the mixture was measured with "Coulter Multisizer 3" (manufactured by Beckman Coulter Inc.), and when the volume-based median diameter d50 of the particles reached 6.0 μm, 37 parts by mass of the amorphous resin particle dispersion liquid (B2) (in terms of solid content) for the shell was added to the mixture over 30 minutes. When a supernatant of the obtained reaction solution became transparent, an aqueous solution in which 190 parts by mass of sodium chloride was dissolved in 760 parts by mass of ion-exchanged water was added to the reaction solution to stop particle growth.

Furthermore, the reaction liquid was heated to 80° C. and stirred to advance particle fusion.

(Cooling Process)

After the above, when the average circularity reaches 0.957 by using a measurement device "FPIA-3000" (manufactured by Sysmex Corporation) for measuring the average circularity of toner particles (HPF detection number: 4000), cooling was performed at a cooling rate of 5° C./min to 30° C.

(Filtering and Washing Process and Drying Process)

Next, after solid-liquid separation was performed and the operation of re-dispersing a dehydrated toner cake in ion-exchanged water and performing solid-liquid separation was repeated three times and washing was performed, drying was performed at 40° C. for 24 hours, so that toner particles (Cy1) were obtained.

(Addition Process for External Additive)

To 100 parts by mass of the obtained toner particles (Cy1), 0.6 parts by mass of hydrophobic silica (number average primary particle diameter=12 nm, degree of hydrophobicity=68) and 1.0 parts by pass of hydrophobic titanium oxide (number average primary particle diameter=20 nm, degree of hydrophobicity=63) were added, and, after the external additive processing process of mixing for 20 minutes at 32° C. at a rotating blade peripheral speed of 35 m/sec by "Henschel mixer" (Mitsui Miike Chemical Co., Ltd.), coarse particles were removed using an open sieve of 45 μm mesh, so that cyan toner Cy1 was obtained.

When the physical properties of the obtained cyan toner Cy1 were measured, the endothermic peak temperature (Tm) was 77° C. and the softening point (Tsp) was 100° C.

<<Production Process of Cyan Developer>>

For the cyan toner Cy1, a ferrite carrier having a volume average particle diameter of 30 μm coated with copolymer resin of cyclohexyl methacrylate and methyl methacrylate (monomer mass ratio=1:1) was used, and mixing was performed so that the toner concentration was 6% by mass, and a cyan developer Cy-1 was obtained.

<Preparation of Toner Cy2 and Developer Cy-2>

Toner Cy2 and a developer Cy-2 were obtained in a similar manner to the aggregation and fusion process and the aging process for the production of the toner Cy1 and the developer Cy-1, except that the amorphous resin particle dispersion liquid (B1) and the crystalline resin particle dispersion liquid (C1) were increased in amount without changing the ratio instead of using the amorphous resin particle dispersion (B2) for the shell.

When the physical properties of the obtained toner Cy2 were measured, the endothermic peak temperature (Tm) was 76° C., and the softening point (Tsp) was 97° C.

<Preparation of Toners Cy3 to Cy10 and Developers Cy-3 to Cy-10>

The toner Cy3 to Cy10 and the developers Cy-3 to Cy-10 were obtained in a similar manner to the aggregation and fusion process and the aging process for the preparation of the toner Cy1 and the developer Cy-1 except that the resin used is changed as shown in Table 3 below.

Table 3 below shows results of measuring physical properties (endothermic peak temperature (Tm) and softening point (Tsp)) of the obtained toners Cy3 to Cy10.

TABLE 3

| | Color toner (cyan toner) | | | | | | | |
|---|---|---|---|---|---|---|---|---|
| | Crystalline resin | | | Amorphous resin | | Resin for | Tm | Tsp |
| Toner No. | No. | Content (% by mass) | CPES HB | No. | Kind | shell No. | (° C.) | (° C.) |
| Cy1 | C1 | 10 | StAc | B1 | StAc | B2 | 77 | 100 |
| Cy2 | C1 | 12 | StAc | B1 | StAc | — | 76 | 97 |
| Cy3 | C2 | 10 | Urethane | B1 | StAc | B2 | 80 | 103 |
| Cy4 | C3 | 10 | None | B1 | StAc | B2 | 69 | 95 |
| Cy5 | C1 | 1 | StAc | B1 | StAc | B2 | 78 | 107 |
| Cy6 | C1 | 21 | StAc | B1 | StAc | B2 | 74 | 90 |
| Cy7 | C4 | 19 | StAc | B1 | StAc | B2 | 86 | 117 |
| Cy8 | C5 | 19 | StAc | B1 | StAc | B2 | 64 | 88 |
| Cy9 | C4 | 3 | StAc | B1 | StAc | B2 | 84 | 113 |
| Cy10 | C5 | 3 | StAc | B1 | StAc | B2 | 66 | 91 |

"CPEs HB" in Table 3 represents other polymer segments chemically bonded (hybrid: HB) to the crystalline polyester polymer segments (CPEs) constituting the crystalline resin. "StAc" in the "CPEs HB" column represents a styrene acrylic polymer segment (StAc), "urethane" represents a urethane polymer segment, and "none" represents that it is not hybrid.

The column of content (% by mass) of the crystalline resin in Table 3 represents the content (% by mass) of the crystalline resin relative to the total binder resin (including the resin for the shell).

"StAc" in the column of the composition of the amorphous resin in Table 3 represents styrene acrylic resin.

"-" in the column of the resin for the shell in Table 3 indicates that the resin for shell is not used, and means that the toner Cy2 does not take the core-shell structure.

<Method for Producing White Toner W1 and White Toner Developer W-1>

(Particle Diameter Control Process)

In a biaxial extrusion kneader, 152.1 parts by mass of crystalline resin (C5) as binder resin, 354.9 parts by mass of amorphous resin (B3), 97.5 parts by mass of anatase-type titanium oxide (volume average particle diameter 150 nm) as a white colorant, and 45.5 parts by mass of behenyl behenate (release agent, melting point 73° C.) were added and kneaded at 120° C. After kneading, cooling was performed to 25° C.

Next, coarse pulverization was performed with a hammer mill, pulverization was performed with a turbo mill pulverizer (manufactured by Turbo Kogyo Co., Ltd.), and further fine powder classification processing was performed with an airflow classifier utilizing the Coanda effect, so that toner base particles having a volume-based median diameter of 8.0 μm were produced.

(Circularity Control Process)

After an aqueous dispersion medium obtained by dissolving 10 parts by mass of sodium dodecyl sulfate in 500 parts by mass of ion-exchanged water and the obtained white toner base particles were added to a reaction vessel equipped with a stirrer, a temperature sensor, and a cooling tube, the mixture was kept at 80° C. for three hours with stirring so that the particle diameter is not changed, and the cooling process was started when the circularity reached 0.927.

Next, solid-liquid separation was performed and the operation of re-dispersing a dehydrated toner cake in ion-exchanged water and performing solid-liquid separation was repeated three times and washing was performed. After washing, the white toner W1 was obtained by drying at 35° C. for 24 hours.

(External Addition Process)

To 100 parts by mass of the obtained white toner base particles, 0.6 parts by mass of hydrophobic silica particles (number average primary particle diameter: 12 nm, hydrophobicity: 68), 1.0 parts by mass of hydrophobic titanium oxide particles (number average primary particle diameter: 20 nm, Hydrophobic degree: 63), and 1.0 part by mass of sol-gel silica (number average primary particle diameter=110 nm) were added, and mixing was performed at 32° C. for 20 minutes with a Henschel mixer (manufactured by NIPPON COKE & ENGINEERING CO., LTD.) at the rotary blade peripheral speed of 40 m/sec. After mixing, coarse particles were removed using a sieve having an opening of 45 μm to obtain a white toner developer W-1.

<Method for Producing White Toners W2 to W6 and White Toner Developers W-2 to W-6>

The white toners W2 to W6 and the white toner developers W-2 to W-6 were obtained in a similar manner to the particle diameter control process of the production of the white toner W1 and the white toner developer W-1, except that the type of resin used, the ratio of the crystalline resin to the binder resin, and the ratio of the colorant (anatase type titanium oxide) to the toner solid content were changed as shown in Table 4 below.

TABLE 4

| | White toner | | | | | | | |
|---|---|---|---|---|---|---|---|---|
| | Crystalline resin | | Amorphous resin | | Content of crystalline | Content of | | |
| Toner No. | No. | Tsp (° C.) | No. | Tsp (° C.) | resin (% by mass) | colorant (% by mass) | Tm (° C.) | Tsp (° C.) |
| W1 | C5 | 78 | B3 | 125 | 30 | 15 | 64 | 115 |
| W2 | C5 | 78 | B2 | 105 | 15 | 15 | 58 | 103 |
| W3 | C4 | 75 | B4 | 140 | 5 | 30 | 81 | 152 |
| W4 | C4 | 75 | B4 | 140 | 5 | 15 | 77 | 149 |
| W5 | C5 | 78 | B2 | 105 | 10 | 15 | 61 | 107 |
| W6 | C5 | 78 | B3 | 125 | 10 | 15 | 63 | 125 |

The column for the content (% by mass) of the crystalline resin in Table 4 shows the contents (% by mass) of the crystalline resins (C4) to (C5) in the binder resin (crystalline resin and amorphous resin).

The column of the content (% by mass) of the colorant in Table 4 represents the content (% by mass) of the colorant with respect to the toner solid content.

Examples 1 to 13, Comparative Examples 1 to 3

In Examples 1 to 13 and Comparative Examples 1 to 3, images were formed as combinations of white toner and color toner described in Table 5 below. Each of evaluations described below was performed by forming an image using the white toner and the color toner. The results are shown in Table 5.

<Low-Temperature Fixability Evaluation>

As an image forming apparatus, a commercially available full-color multifunction device "bizhub (registered trademark) C754" (manufactured by Konica Minolta, Inc.) was modified so that the surface temperature of the upper fixing roller and the lower fixing roller can be changed and equipped with a white toner image forming unit at a black position was used, and a developer of each color prepared above was used to perform evaluation. A test in which a solid image of white toner (see Table 5) with an adhesion amount of 3.4 g/m$^2$ was attached on top of A4 (basis weight 80 g/m$^2$) plain paper), and cyan toner (see Table 5) of color toner with an adhesion amount of 3.0 g/m$^2$ was further attached, and the image was output with a nip width of 11.2 mm, a fixing time of 34 msec, and fixing pressure of 133 kPa, and at a fixing temperature of 100° C. to 200° C. was repeatedly performed while the fixing temperature was changed in units of 5° C. That is, the color toner other than the white toner and the white toner are thermally fixed at the same time.

The lowest fixing temperature at which image staining due to fixing offset was not visually confirmed was defined as the minimum fixing temperature. The minimum fixing temperature obtained is shown in Table 5 below.

(Evaluation Criteria for Low-Temperature Fixability)

⊙: Minimum fixing temperature less than 145° C. (low-temperature fixability of toner is extremely good)

○: Minimum fixing temperature 145° C. or higher and lower than 155° C. (low-temperature fixability of toner is good)

Δ: Minimum fixing temperature 155° C. or higher and lower than 165° C. (low-temperature fixability of toner is slightly good)

x: Minimum fixing temperature of 165° C. or higher (low-temperature fixability of toner is poor and cannot be used).

<Hot Offset Resistance>

Developers produced from the toners described above were loaded into copiers modified in a similar manner to the copiers used in the <low-temperature fixability evaluation>.

As similar to <Low-temperature fixability evaluation> above, a test in which a solid image of white toner (see Table 5) with an adhesion amount of 3.4 g/m$^2$ was attached on top of A4 plain paper "J paper (64 g/m$^2$)" (manufactured by Konica Minolta, Inc.) under an environment of normal temperature and humidity (temperature 20° C., relative humidity 50% RH), and cyan toner (see Table 5) of color toner with an adhesion amount of 3.0 g/m$^2$ was further attached, and the image was output at a fixing temperature of 100° C. to 200° C. under the conditions of the nip pressure of 238 kPa, the nip time of 25 milliseconds (process speed 480 mm/s) was repeatedly performed while the fixing temperature was changed in units of 5° C. That is, the color toner other than the white toner and the white toner are thermally fixed at the same time.

The hot offset (H.O.) of the solid image was visually evaluated, and the hot offset resistance was evaluated according to evaluation criteria described below. Rank 2 or higher was accepted. The evaluation results are shown in Table 5 below.

(Evaluation Criteria for Hot Offset Resistance)

4: No hot offset below 200° C.

3: Hot offset occurs at over 190° C. and 200° C. or lower

2: Hot offset occurs at over 180° C. and 190° C. or lower

1: Hot offset occurs at 180° C. or lower

TABLE 5

| | White toner | | | Color toner | | | | | |
|---|---|---|---|---|---|---|---|---|---|
| | No. | Tmw (° C.) | Tspw (° C.) | No. | Tmc (° C.) | Tspc (° C.) | Content of crystalline resin (% by mass) | CPES HB | Kind of amorphous resin |
| Example 1 | W1 | 65 | 115 | Cy1 | 77 | 100 | 10 | StAc | StAc |
| Example 2 | W1 | 65 | 115 | Cy2 | 76 | 97 | 12 | StAc | StAc |
| Example 3 | W1 | 65 | 115 | Cy3 | 80 | 103 | 10 | Urethane | StAc |
| Example 4 | W1 | 65 | 115 | Cy4 | 69 | 95 | 10 | None | StAc |
| Example 6 | W1 | 65 | 115 | Cy5 | 77 | 110 | 1 | StAc | StAc |
| Example 7 | W1 | 65 | 115 | Cy6 | 74 | 90 | 21 | StAc | StAc |
| Example 8 | W2 | 58 | 103 | Cy10 | 66 | 91 | 3 | StAc | StAc |
| Example 9 | W3 | 81 | 152 | Cy9 | 84 | 113 | 3 | StAc | StAc |
| Example 10 | W4 | 77 | 149 | Cy7 | 86 | 117 | 19 | StAc | StAc |
| Example 11 | W5 | 61 | 107 | Cy8 | 64 | 88 | 19 | StAc | StAc |
| Example 12 | W1 | 65 | 115 | Cy9 | 84 | 113 | 3 | StAc | StAc |
| Example 13 | W4 | 77 | 149 | Cy3 | 80 | 103 | 10 | Urethane | StAc |
| Comparative Example 1 | W1 | 65 | 115 | Cy10 | 66 | 91 | 3 | StAc | StAc |
| Comparative Example 2 | W6 | 63 | 125 | Cy9 | 84 | 113 | 3 | StAc | StAc |
| Comparative Example 3 | W5 | 61 | 107 | Cy5 | 77 | 110 | 1 | StAc | StAc |

| | Color toner | | | Evaluation | | |
|---|---|---|---|---|---|---|
| | | | | Low-temperature fixability | | |
| | Presence of core-shell structure | Tmc − Tmw (° C.) | Tspw − Tspc (° C.) | Minimum fixing temperature (° C.) | Evaluation of low-temperature fixability | Hot offset resistance |
| Example 1 | Yes | 12 | 15 | 141 | ◎ | 4 |
| Example 2 | No | 11 | 18 | 143 | ◎ | 3 |
| Example 3 | Yes | 15 | 12 | 147 | ○ | 3 |
| Example 4 | Yes | 4 | 20 | 151 | ○ | 3 |
| Example 6 | Yes | 12 | 5 | 157 | Δ | 3 |
| Example 7 | Yes | 9 | 25 | 146 | ○ | 3 |
| Example 8 | Yes | 8 | 12 | 144 | ◎ | 2 |
| Example 9 | Yes | 3 | 39 | 158 | Δ | 3 |
| Example 10 | Yes | 9 | 32 | 156 | Δ | 2 |
| Example 11 | Yes | 3 | 19 | 151 | ○ | 2 |
| Example 12 | Yes | 19 | 2 | 148 | ○ | 2 |
| Example 13 | Yes | 3 | 46 | 159 | Δ | 2 |
| Comparative Example 1 | Yes | 1 | 24 | 147 | ○ | 1 |
| Comparative Example 2 | Yes | 21 | 12 | 152 | ○ | 1 |
| Comparative Example 3 | Yes | 16 | −3 | 157 | Δ | 1 |

"CPEs HB" of color toner in Table 5 represents other polymer segments chemically bonded (hybrid: HB) to the crystalline polyester polymer segments (CPEs) constituting the crystalline resin. "StAc" in the "CPEs HB" column represents a styrene acrylic polymer segment (StAc), "urethane" represents a urethane polymer segment, and "none" represents that it is not hybrid.

The column of "content (% by mass) of crystalline resin" of color toner in Table 5 represents the content (% by mass) of the crystalline resin relative to the total binder resin (including the resin for the shell).

"StAc" in the column of the kind of the amorphous resin in Table 5 represents styrene acrylic resin.

From the results shown in Table 5 above, it was found that images formed using the white toners and color toners of Examples 1 to 13 were excellent in low-temperature fixability and hot offset resistance.

On the other hand, it was found that the images formed using the white toner and the color toner of Comparative Examples 1 to 3 had no problem with low-temperature fixability, but the hot offset resistance was lowered.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming method comprising forming an image by transferring and fixing white toner and color toner of at least one color to a recording medium, wherein when an endothermic peak top temperature and a toner softening point in a first temperature increasing process in differential scanning calorimetry of the white toner are Tmw (° C.) and Tspw (° C.), respectively, and an endothermic peak top temperature and a toner softening point in a first temperature increasing process in differential scanning calorimetry of the color toner are Tmc (° C.) and Tspc (° C.), respectively, Equations (1) and (2) below are satisfied.

[Math. 1]

$$3 \leq (Tmc - Tmw) \leq 20 \quad (1)$$

$$Tspw > Tspc \quad (2)$$

2. The image forming method according to claim 1, wherein the color toner contains binder resin, and the binder resin contains vinyl resin.

3. The image forming method according to claim 1, wherein the Tspc (° C.) and the Tspw (° C.) satisfy Equation (3) below.

[Math. 2]

$$5 \leq (Tspw - Tspc) \leq 45 \quad (3)$$

4. The image forming method according to claim 1, wherein the Tmc (° C.) and the Tspc (° C.) satisfy Equations (4) and (5) below.

[Math. 3]

$$65 \leq Tmc \leq 85 \quad (4)$$

$$90 \leq Tspc \leq 115 \quad (5)$$

5. The image forming method according to claim 1, wherein the Tmw (° C.) and the Tspw (° C.) satisfy Equations (6) and (7) below.

[Math. 4]

$$60 \leq Tmw \leq 80 \quad (6)$$

$$105 \leq Tspw \leq 150 \quad (7)$$

6. The image forming method according to claim 1, wherein the color toner contains crystalline resin as binder resin, and a content of the crystalline resin with respect to the total binder resin is in a range of 2.0% to 20% by Mass.

7. The image forming method according to claim 6, wherein the crystalline resin is crystalline polyester resin.

8. The image forming method according to claim 7, wherein the crystalline polyester resin is hybrid crystalline polyester resin having a structure in which a crystalline polyester polymer segment and an amorphous polymer segment other than the polyester polymer segment are chemically bonded.

9. The image forming method according to claim 8, wherein the amorphous polymer segment is a vinyl polymer segment.

10. The image forming method according to claim 1, wherein the color toner is toner having a core-shell structure.

* * * * *